US009741312B2

(12) United States Patent
Fujikawa

(10) Patent No.: US 9,741,312 B2
(45) Date of Patent: Aug. 22, 2017

(54) ELECTRO-OPTICAL APPARATUS, METHOD OF DRIVING ELECTRO-OPTICAL APPARATUS, AND ELECTRONIC EQUIPMENT

(71) Applicant: SEIKO EPSON CORPORATION, Tokyo (JP)

(72) Inventor: Shinsuke Fujikawa, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 112 days.

(21) Appl. No.: 14/555,480

(22) Filed: Nov. 26, 2014

(65) Prior Publication Data

US 2015/0154926 A1 Jun. 4, 2015

(30) Foreign Application Priority Data

Dec. 2, 2013 (JP) ..... 2013-248932

(51) Int. Cl.
*G09G 3/36* (2006.01)

(52) U.S. Cl.
CPC ... *G09G 3/3688* (2013.01); *G09G 2310/0218* (2013.01); *G09G 2310/0251* (2013.01); *G09G 2310/0297* (2013.01); *G09G 2320/0214* (2013.01); *G09G 2330/021* (2013.01)

(58) Field of Classification Search
CPC ... G09G 2310/0251; G09G 2310/0297; G09G 2310/0214; G09G 2310/0218; G09G 3/3688; G09G 2330/021
See application file for complete search history.

(56) References Cited

U.S. PATENT DOCUMENTS 5,892,493 A * 4/1999 Enami ..... G09G 3/3688 345/100
6,266,039 B1 7/2001 Aoki
6,847,344 B2 * 1/2005 Ha ..... G09G 3/3648 345/95
2006/0221701 A1 10/2006 Sun
2010/0045638 A1 * 2/2010 Cho ..... G09G 3/3688 345/204
2012/0056917 A1 * 3/2012 Ito ..... G09G 3/3688 345/691

FOREIGN PATENT DOCUMENTS

WO 99/04384 A1 1/1999

* cited by examiner

*Primary Examiner* — Liliana Cerullo
(74) *Attorney, Agent, or Firm* — Maschoff Brennan

(57) ABSTRACT

An electro-optical apparatus includes scanning lines; signal lines; pixels; and a drive unit. The signal lines are divided into k signal line groups (k is an integer of two or greater). The drive unit includes a precharging circuit that supplies precharging signals to the signal lines, and an image signal circuit that supplies image signals to the signal lines. The image signal circuit includes k image sequence lines and k groups of switches. The precharging circuit includes k precharging sequence lines and k groups of precharging switches.

11 Claims, 15 Drawing Sheets

AMOUNT OF CROSSTALK [%]
= (BACKGROUND LUMINANCE GRADIENT B – LUMINANCE C OF CROSSTALK PORTION) / BACKGROUND LUMINANCE GRADIENT B × 100

EXAMPLE OF EVALUATION OF AMOUNT OF VERTICAL CROSSTALK WHEN BACKGROUND LUMINANCE GRADIENT IS 10%

ELECTRO-OPTICAL APPARATUS, METHOD OF DRIVING ELECTRO-OPTICAL APPARATUS, AND ELECTRONIC EQUIPMENT

BACKGROUND

1. Technical Field

The present invention relates to an electro-optical apparatus, a method of driving the electro-optical apparatus, and electronic equipment.

2. Related Art

A light-transmitting electro-optical apparatus or a light-reflecting electro-optical apparatus is used in electronic equipment with a display function. Light is radiated onto the electro-optical apparatus, and transmitted light or reflected light modulated by the electro-optical apparatus forms a display image, or is projected on a screen and forms a projected image. A liquid crystal apparatus is known as the electro-optical apparatus used in the electronic equipment, and forms an image using dielectric anisotropy of liquid crystal and the optical rotation of light in a liquid crystal layer. In the liquid crystal apparatus, scanning lines and signal lines are disposed in an image display region, and pixels are disposed in a matrix form at the intersection points of the scanning lines and the signal lines, respectively. A pixel transistor is provided at each pixel, and an image is formed by supplying an image signal to each pixel via the pixel transistor.

For example, International Publication No. 99/04384 pamphlet discloses a method of obtaining a high-quality display picture in the electro-optical apparatus or the electronic equipment using the electro-optical apparatus. FIG. 15 is a timing chart illustrating a drive method disclosed in International Publication No. 99/04384 pamphlet. As illustrated in FIG. 15, in International Publication No. 99/04384 pamphlet, a precharging operation is executed once on each of horizontal scanning periods for the entirety of the signal lines. The precharging operation is executed before an image signal is written into each pixel, and the voltage of the precharging operation is appropriately set depending on a writing polarity. The precharging operation prevents the occurrence of vertical crosstalk that is caused by an optical leak current of the pixel transistor, and thus a high-quality image is displayed. In particular, when the liquid crystal apparatus is applied to a projector or the like onto which large light fluxes are incident, this method demonstrates great effects.

However, there is a problem in that the display method disclosed in International Publication No. 99/04384 pamphlet has low compatibility with the provision of a high-definition image display. The horizontal scanning period becomes shorter as the degree of high definition of the liquid crystal apparatus increases further. The reason for this is because when the precharging operation is executed each horizontal scanning period, a period for writing the image signal becomes short, and the image signal cannot be accurately supplied to each pixel. In addition, in the display method disclosed in International Publication No. 99/04384 pamphlet, there is a problem in that power consumption increases, and the reliability of the electro-optical apparatus deteriorates. Since the precharging operation is a charging and discharging operation different from the image signal, the precharging operation inevitably increases power consumption. An increase in power consumption causes a drive semiconductor apparatus to generate heat, and the operational stability of the drive semiconductor apparatus or the electro-optical apparatus is adversely affected. In other words, there is a problem in that it is difficult for the electro-optical apparatus of the related art to stably display a high-definition image having reduced crosstalk with low power consumption.

SUMMARY

The present invention can be realized as the following embodiments or application examples.

Application Example 1

According to this application example, there is provided an electro-optical apparatus including: a plurality of scanning lines; a plurality of signal lines; pixels that are disposed to correspond to the intersections of the plurality of scanning lines and the plurality of signal lines, respectively; and a drive unit that supplies drive signals to the plurality of scanning lines and the plurality of signal lines. The plurality of signal lines are divided into k signal line groups (k is an integer of two or greater). The drive unit includes a precharging circuit that supplies precharging signals to the plurality of signal lines, and an image signal circuit that supplies image signals to the plurality of signal lines. The image signal circuit includes k image sequence lines and k groups of switches. The precharging circuit includes k precharging sequence lines and k groups of precharging switches.

With this configuration, in a horizontal scanning period, while the precharging signals are supplied to a part of the k signal line groups, the image signals can be supplied to the other part of the k signal line groups. For this reason, in the horizontal scanning period, when supplying the image signals to the k signal line groups, the precharging signals are supplied to the part of the k signal line groups, and then the image signals are supplied thereto, and in contrast, the image signals are supplied to the remainder of the k signal line groups without supplying the precharging signals thereto. As a result, since the occurrence of crosstalk is prevented, and the frequency of precharging operations is reduced, power consumption is also reduced. Accordingly, a heat quantity is reduced, thereby improving the operational stability of the electro-optical apparatus. That is, it is possible to realize the electro-optical apparatus that stably displays a high-definition image having reduced crosstalk with low power consumption.

Application Example 2

According to this application example, there is provided an electro-optical apparatus including: a plurality of scanning lines; a plurality of signal lines; pixels that are disposed to correspond to the intersections of the plurality of scanning lines and the plurality of signal lines, respectively; and a drive unit that supplies drive signals to the plurality of scanning lines and the plurality of signal lines. The plurality of signal lines are divided into k signal line groups (k is an integer of two or greater). The drive unit includes a precharging circuit that supplies precharging signals to the plurality of signal lines, and an image signal circuit that supplies image signals to the plurality of signal lines. The image signal circuit includes k image sequence lines and k groups of switches. The precharging circuit includes k positive precharging sequence lines, k groups of positive precharging switches, k negative precharging sequence lines, and k groups of negative precharging switches.

With this configuration, in a horizontal scanning period, while the precharging signals are supplied to a part of the k signal line groups, the image signals are supplied to the other part of the k signal line groups. For this reason, in the horizontal scanning period, when supplying the image signals to the k signal line groups, the precharging signals are supplied to the part of the k signal line groups, and then the image signals are supplied thereto, and in contrast, the image signals are supplied to the remainder of the k signal line groups without supplying the precharging signals thereto. As a result, since the occurrence of crosstalk is prevented, and the frequency of precharging operations is reduced, power consumption is also reduced. Accordingly, a heat quantity is reduced, thereby improving the operational stability of the electro-optical apparatus. That is, it is possible to realize the electro-optical apparatus that stably displays a high-definition image having reduced crosstalk with low power consumption.

Application Example 3

In the electro-optical apparatus according to Application Example 1 or 2, it is preferable that when supplying image signals to the k signal line groups in a horizontal scanning period, the drive unit supply precharging signals to a part of the k signal line groups, and then supply the image signals thereto, and in contrast, supply the image signals to the remainder of the k signal line groups without supplying the precharging signals thereto.

With this configuration, the occurrence of crosstalk is prevented, and the frequency of precharging operations is reduced, and thus power consumption is also reduced. Accordingly, a heat quantity is reduced, thereby improving the operational stability of the electro-optical apparatus. That is, it is possible to realize the electro-optical apparatus that stably displays a high-definition image having reduced crosstalk with low power consumption.

Application Example 4

In the electro-optical apparatus according to any one of Application Examples 1 to 3, it is preferable that in a first horizontal scanning period, the drive unit supply the precharging signals to the part of the k signal line groups, and then supply the image signals thereto, and in contrast, supply the image signals to the remainder of the k signal line groups without supplying the precharging signals thereto. It is preferable that in a second horizontal scanning period subsequent to the first horizontal scanning period, the drive unit supply the precharging signals to the part of the k signal line groups, and then supply the image signals thereto, and in contrast, supply the image signals to the remainder of the k signal line groups without supplying the precharging signals thereto. It is preferable that the signal lines to which the precharging signals are supplied be different between the first horizontal scanning period and the second horizontal scanning period.

With this configuration, the signal lines to which the precharging signals are supplied are different between the first horizontal scanning period and the second horizontal scanning period, and thus it is possible to reduce the frequency of precharging operations, and change the signal lines, to which the precharging signals are supplied, between the first and second horizontal scanning periods.

Application Example 5

In the electro-optical apparatus according to any one of Application Examples 1 to 4, it is preferable that a vertical scanning period include at least first to k-th horizontal scanning periods. It is preferable that in each of the first to k-th horizontal scanning periods, the drive unit supply the precharging signals to the part of the k signal line groups, and then supply the image signals thereto, and in contrast, supply the image signals to the remainder of the k signal line groups without supplying the precharging signals thereto. It is preferable that the drive unit supply the precharging signals to the entirety of the k signal line groups in the first to k-th horizontal scanning periods.

With this configuration, it is possible to reduce the frequency of precharging operations, and supply the precharging signals to the entirety of the signal lines.

Application Example 6

In the electro-optical apparatus according to Application Example 5, it is preferable that the vertical scanning period include a horizontal scanning period in which the image signals are supplied to the entirety of the k signal line groups without the precharging signals being supplied thereto.

With this configuration, the vertical scanning period includes the horizontal scanning period in which the precharging signals are not supplied, and thus it is possible to further reduce the frequency of precharging operations.

Application Example 7

In the electro-optical apparatus according to Application Example 5 or 6, it is preferable that in the vertical scanning period, the drive unit supply the precharging signals to each of the k signal line groups multiple times. It is preferable that a period between the supply of a precharging signal and the supply of a subsequent precharging signal with respect to a signal line group be set to 32 horizontal scanning periods or less.

With this configuration, it is possible to prevent the occurrence of crosstalk.

Application Example 8

According to this application example, there is provided electronic equipment that is provided with the electro-optical apparatus according to any of Application Examples 1 to 7.

With this configuration, it is possible to realize the electronic equipment that is provided with the electro-optical apparatus which stably displays a high-definition image having reduced crosstalk with low power consumption.

Application Example 9

According to this application example, there is provided a method of driving an electro-optical apparatus including a plurality of scanning lines, a plurality of signal lines, and pixels which are disposed to correspond to the intersections of the plurality of scanning lines and the plurality of signal lines, in which the plurality of signal lines are divided into k signal line groups (k is an integer of two or greater), in which a vertical scanning period includes at least a first horizontal scanning period, and in which in the first horizontal scanning period, while precharging signals are supplied to a part of the k signal line groups, image signals are supplied to the other part of the k signal line groups.

With this configuration, since this method prevents the occurrence of crosstalk, and reduces the frequency of precharging operations, power consumption is also reduced.

Accordingly, a heat quantity is reduced, thereby improving the operational stability of the electro-optical apparatus. That is, it is possible to realize the electro-optical apparatus that stably displays a high-definition image having reduced crosstalk with low power consumption.

Application Example 10

In the method of driving an electro-optical apparatus according to Application Example 9, it is preferable that the vertical scanning period further include a second horizontal scanning period. It is preferable that in the second horizontal scanning period, while the precharging signals are supplied to the part of the k signal line groups, the image signals be supplied to the other part of the k signal line groups. It is preferable that the signal lines to which the precharging signals are supplied be different between the first horizontal scanning period and the second horizontal scanning period.

With this configuration, the signal lines to which the precharging signals are supplied are different between the first horizontal scanning period and the second horizontal scanning period, and thus it is possible to reduce the frequency of precharging operations, and change the signal lines, to which the precharging signals are supplied, between the first and second horizontal scanning periods.

Application Example 11

According to this application example, there is provided a method of driving an electro-optical apparatus including a plurality of scanning lines, a plurality of signal lines, and pixels which are disposed to correspond to the intersections of the plurality of scanning lines and the plurality of signal lines, in which the plurality of signal lines are divided into k signal line groups (k is an integer of two or greater), in which a vertical scanning period includes at least the k horizontal scanning periods from first to k-th horizontal scanning periods, and in which the precharging signal is supplied to each of the k signal lines the same times in the first to k-th horizontal scanning periods.

With this configuration, it is possible to reduce the frequency of precharging operations, and supply the precharging signals to the entirety of the signal lines.

Application Example 12

According to this application example, there is provided an electro-optical apparatus that is driven by the method of driving the electro-optical apparatus according to any one of Application Examples 9 to 11.

With this configuration, it is possible to realize the electro-optical apparatus that stably displays a high-definition image having reduced crosstalk with low power consumption.

Application Example 13

According to this application example, there is provided electronic equipment that is provided with the electro-optical apparatus according to Application Example 12.

With this configuration, it is possible to realize the electronic equipment that is provided with the electro-optical apparatus which stably displays a high-definition image having reduced crosstalk with low power consumption.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the present invention will be described with reference to the accompanying drawings. In each of the drawings, the size of each layer or member is set to the extent of being recognizable, and the scale of each layer or member is different from the actual scale.

First Embodiment

Outline of Electronic Equipment

Figure 1:
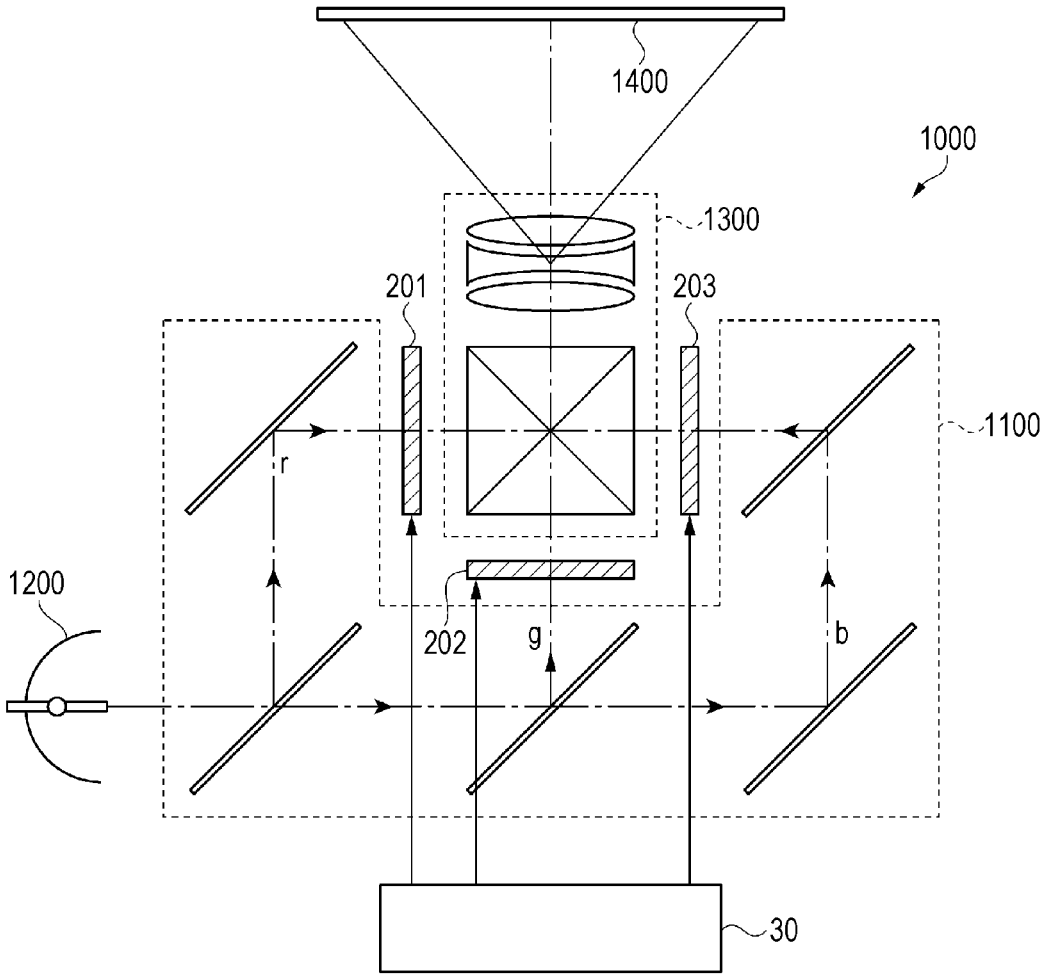
FIG. 1 is a schematic view of a projection display apparatus (three-plate projector) as an example of electronic equipment.

FIG. 1 is a schematic view of a projection display apparatus (three-plate projector) as an example of electronic equipment. Hereinafter, the configuration of the electronic equipment will be described with reference to FIG. 1.

The electronic equipment (a light-transmitting display apparatus 1000) has at least a three-plate electro-optical apparatus 20 (refer to FIG. 2) (hereinafter, simply referred to as a first panel 201, a second panel 202, or a third panel 203) and a control apparatus 30 that supplies a control signal to the electro-optical apparatus 20. The first panel 201, the second panel 202, and the third panel 203 are three electro-optical apparatuses 20 that correspond to different display colors (a red color, a green color, and a blue color), respectively. Hereinafter, in particular, when it is not necessary to differentiate the first panel 201, the second panel 202, and the third panel 203 from each other, the first panel 201, the second panel 202, and the third panel 203 are simply and comprehensively referred to as the electro-optical apparatus 20.

In light emitted from an illumination apparatus (light source) 1200, an illumination optical system 1100 supplies a red color component r to the first panel 201, a green color component g to the second panel 202, and a blue color component b to the third panel 203. The electro-optical apparatus 20 functions as a light modulator (light valve) that modulates color light supplied from the illumination optical system 1100 depending on a display image. A projection optical system 1300 combines light emitted from the electro-optical apparatuses 20, and projects the light onto a projection surface 1400.

Circuit Configuration of Electronic Equipment

Figure 2:
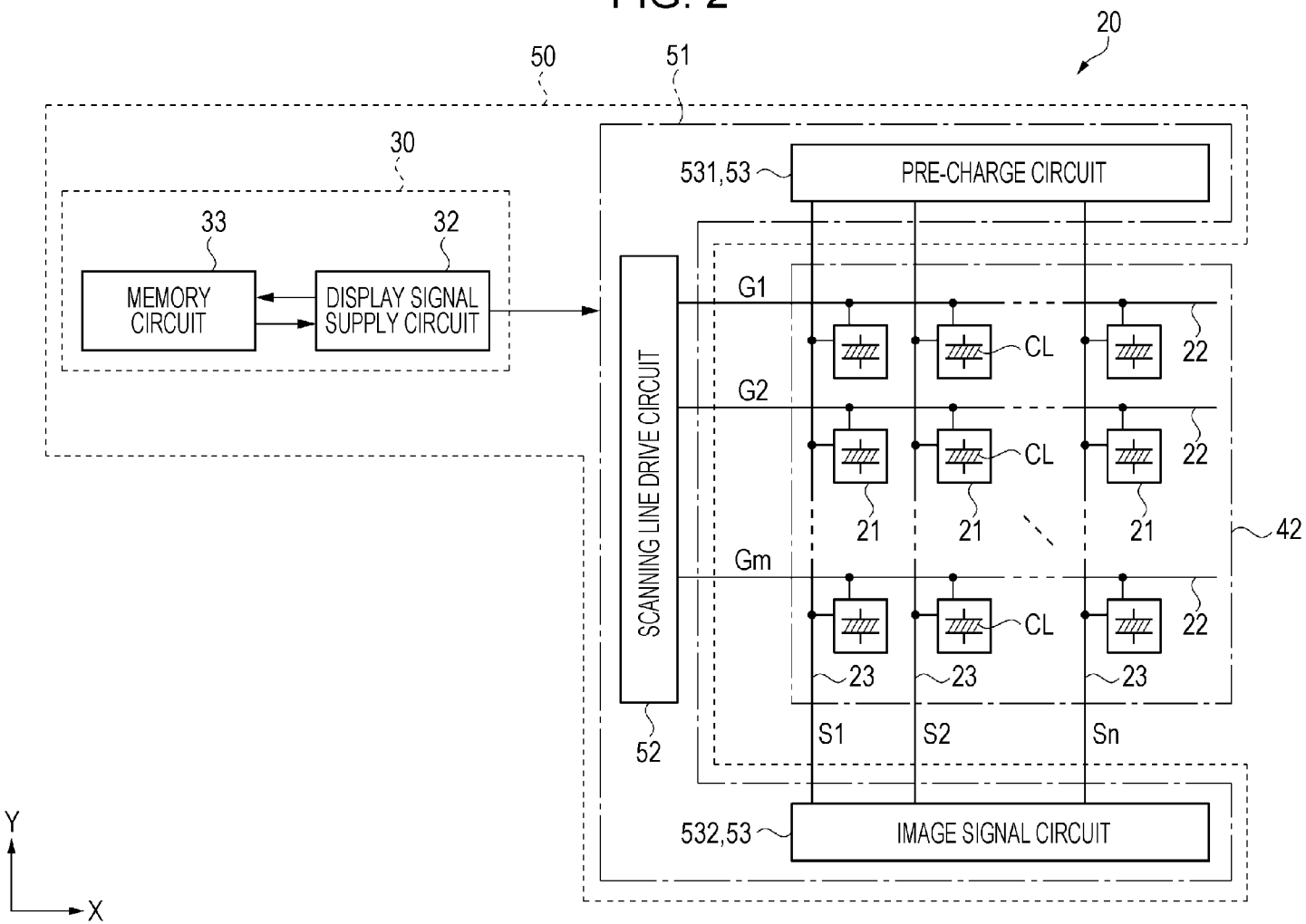
FIG. 2 is a circuit block diagram of an electro-optical apparatus.

FIG. 2 is a circuit block diagram of the electro-optical apparatus. Subsequently, a circuit block configuration of the electro-optical apparatus 20 will be described with reference to FIG. 2.

As illustrated in FIG. 2, the electro-optical apparatus 20 includes at least a display region 42 and a drive unit 50. In the display region 42, a plurality of scanning lines 22 and a plurality of signal lines 23 are formed to intersect each other, and pixels 21 are arranged in a matrix form so as to correspond to the intersections of the scanning lines 22 and the signal lines 23, respectively. The scanning lines 22 extend in a horizontal direction, and the signal lines 23 extend in a vertical direction. A scanning line Gi refers to the scanning line 22 specified at an i-th row among the scanning lines 22, and a signal line Sjk+p refers to the signal line 23 specified at a (jk+p)-th column among the signal lines 23 (j, k, and p will be described later). In the display region 42, the m scanning lines 22 and the n signal lines 23 are formed (m is an integer greater than or equal to two, and n is an integer greater than or equal to two). In the embodiment, a method of driving the electro-optical apparatus 20 will be described referring to an example in which m is equal to 2168 and n is equal to 4112. At this time, a so-called 4K image (2160 rows×4096 columns) is displayed in the display region 42 (2168 rows×4112 columns).

The drive unit 50 supplies various signals to the display region 42, and an image is displayed in the display region 42. That is, the drive unit 50 supplies drive signals to the plurality of scanning lines 22 and the plurality of signal lines 23. Specifically, the drive unit 50 includes a drive circuit 51 that drives the pixels 21; a display signal supply circuit 32 that supplies display signals to the drive circuit 51; and a memory circuit 33 that temporarily stores a frame image. The display signal supply circuit 32 prepares display signals (image signals, clock signals, and the like) from the frame image stored on the memory circuit 33, and supplied to the drive circuit 51. The display signal supply circuit 32 prepares a precharging signal VPRC (refer to FIG. 5), and supplies the precharging signal VPRC to the drive circuit 51.

Figure 4:
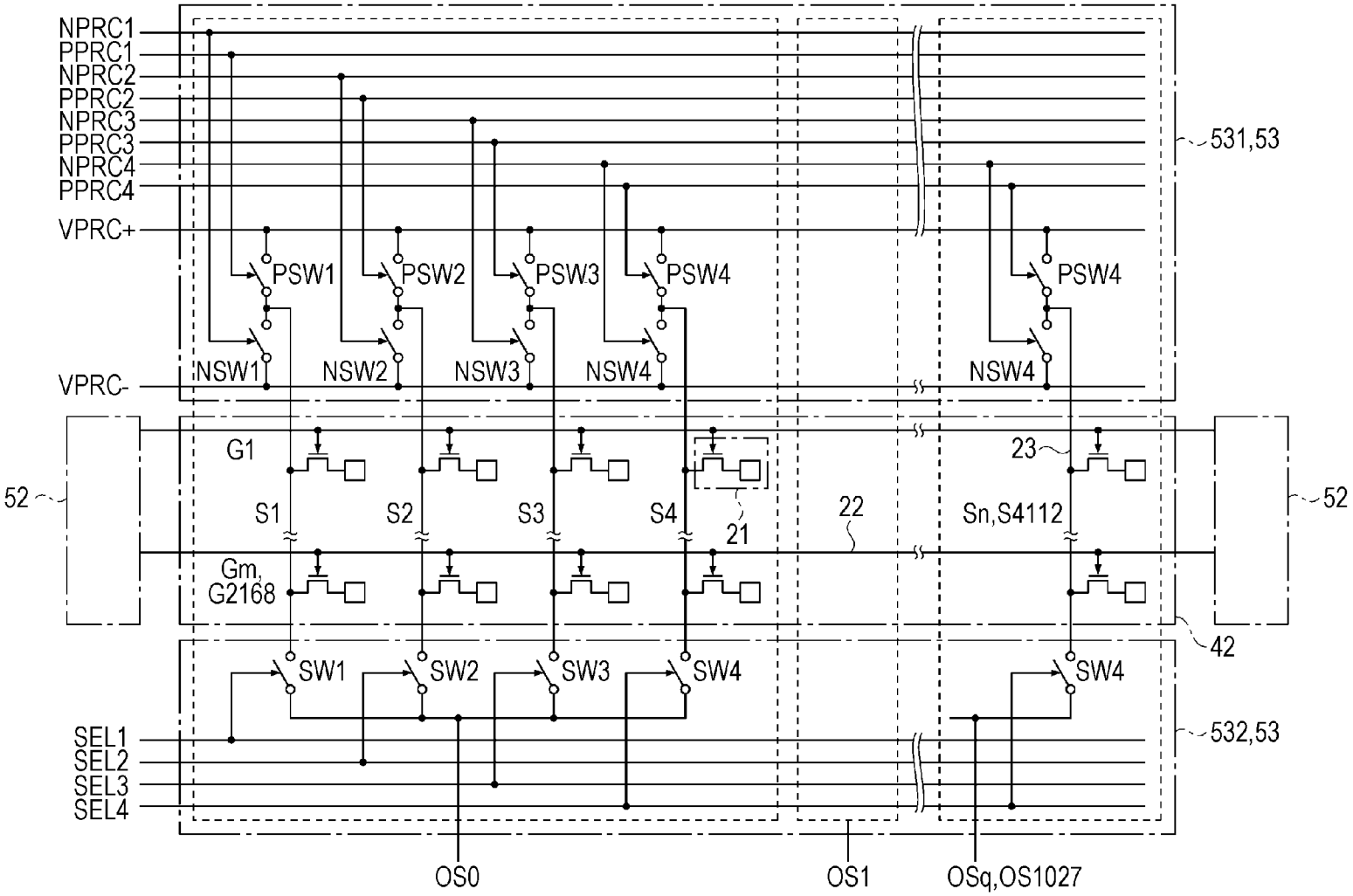
FIG. 4 is a diagram illustrating a circuit configuration of a signal line drive circuit according to a first embodiment.

The drive circuit 51 includes a scanning line drive circuit 52 and a signal line drive circuit 53. A second side (right side of the display region in the embodiment) refers to a side of the display region 42 which is opposite to (is substantially parallel with) a first side (left side of the display region in the embodiment) of the display region 42 with the display region 42 interposed between the first and second sides, a third side (a lower side of the display region in the embodiment) refers to a side of the display region 42 which intersects (is substantially orthogonal to) the first side, and a fourth side (an upper side of the display region in the embodiment) refers to a side of the display region 42 which is opposite to (is substantially parallel with) the third side with the display region 42 interposed between the third and fourth sides. The scanning line drive circuit 52 is formed along the first side, the second side, or the first and second sides of the display region 42. FIG. 2 does not illustrate a part of the scanning line drive circuit 52 for illustrative purposes, and in the embodiment, as illustrated in FIG. 4, the scanning line drive circuit 52 is formed along the first and second sides of the display region 42. In contrast, the signal line drive circuit 53 is formed along the third side or the fourth side of the display region 42, or the signal line drive circuits 53 are formed along the third and fourth sides. In the embodiment, a part (a precharging circuit 531 in the embodiment) of the signal line drive circuit 53 is formed along the fourth side of the display region 42, and the other part (an image signal circuit 532 in the embodiment) of the signal line drive circuit 53 is formed along the third side of the display region 42.

The scanning line drive circuit 52 outputs scanning signals to the scanning lines 22 so as to select or not to select pixels in the horizontal direction, and the scanning lines 22 transmit the scanning signals to the pixels 21. In other words, the scanning signal is in a selection state or a non-selection state, and the scanning line 22 receives the scanning signal from the scanning line drive circuit 52, and can appropriately select a pixel. The scanning line drive circuit 52 includes a shift register circuit (not illustrated), and outputs a shift output signal by one stage so as to shift the shift register circuit. The scanning signal is formed using the shift output signal.

The signal line drive circuit 53 includes the precharging circuit 531 that supplies the precharging signals VPRC to the plurality of signal lines 23, and the image signal circuit 532 that supplies image signals to the plurality of signal lines 23. In synchronization with the selection of the scanning lines 22, the signal line drive circuit 53 can supply the precharging signals VPRC or the image signals to the n signal lines 23.

A piece of display image is formed in one frame period. Each of the scanning lines 22 is selected at least once for one frame period. Typically, each of the scanning lines 22 is selected once. A horizontal scanning period refers to a period for which one scanning line is selected, and thus one frame period includes at least the m horizontal scanning periods. Since one frame period is configured when the scanning lines 22 are selected in sequence from a scanning line G1 of the first row to a scanning line Gm of the m-th row (or, from the scanning line Gm of the m-th row to the scanning line G1 of the first row), the frame period is referred to as a vertical scanning period.

In the embodiment, the electro-optical apparatus 20 is formed by a glass substrate (not illustrated), and the drive circuit 51 is formed by a thin film element such as a thin film transistor provided on the glass substrate. The control apparatus 30 includes the display signal supply circuit 32 and the memory circuit 33, and is configured by a semiconductor integrated circuit formed on a single crystal semiconductor substrate. In other configurations, the display region 42 may be formed on the glass substrate, and the drive circuit 51 may be an integrated circuit formed on the single crystal semiconductor substrate, or both of the display region 42 and the drive circuit 51 may be formed on the single crystal semiconductor substrate.

Configuration of Pixel

Figure 3:
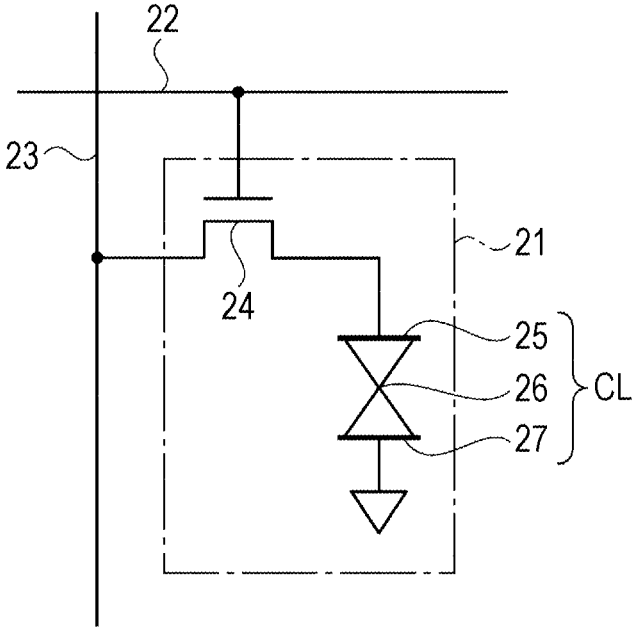
FIG. 3 is a circuit diagram of a pixel.

FIG. 3 is a circuit diagram of each pixel. Subsequently, the configuration of the pixel 21 will be described with reference to FIG. 3.

The electro-optical apparatus 20 of the embodiment is a liquid crystal apparatus, and an electro-optical material is liquid crystal 26. As illustrated in FIG. 3, the pixel 21 includes a liquid crystal element CL and a pixel transistor 24. The liquid crystal element CL is an electro-optical element which has a pixel electrode 25 and a common electrode 27 facing each other, and in which the liquid crystal 26 as the electro-optical material is disposed between the electrodes. The transmittance of the liquid crystal 26 for light penetrating therethrough changes in response to an electric field applied between the pixel electrode 25 and the common electrode 27. Instead of the liquid crystal 26, an electrophoretic material may be used as the electro-optical material. At this time, the electro-optical apparatus 20 becomes an electrophoretic apparatus, and is used in an electronic book or the like.

The pixel transistor 24 is formed by an N-type thin film transistor, a gate of which is connected to the scanning line 22. The pixel transistor 24 is interposed between the liquid crystal element Cl and the signal line 23, and controls an electrical connection (energization/non-energization) therebetween. Accordingly, when the pixel transistor 24 is turned on, the pixel 21 (the liquid crystal element CL) displays an image in response to potential (image signal) supplied to the signal line 23. FIG. 3 does not illustrate an auxiliary capacitor connected to the liquid crystal element CL in parallel and the like.

Signal Line Drive Circuit

FIG. 4 is a diagram illustrating a circuit configuration of a signal line drive circuit according to the first embodiment. Subsequently, the configuration of the signal line drive circuit 53 with reference to FIG. 4 will be described.

The signal line drive circuit 53 includes the image signal circuit 532 and the precharging circuit 531 which is formed along the upper side or the lower side of the display region 42. The image signal circuit 532 includes k image sequence lines from a first image sequence line to a k-th image sequence line, and k groups of switches from a first switch SW1 to a k-th switch SWk. k is an integer greater than or equal to two, and in the embodiment, k is four (k=4) as an example. In contrast, the precharging circuit 531 includes k positive precharging sequence lines from a first positive precharging sequence line to a k-th positive precharging sequence line; k groups of positive precharging switches from a first positive precharging switch PSW1 to a k-th positive precharging switch PSWk; k negative precharging sequence lines from a first negative precharging sequence line to a k-th negative precharging sequence line; and k groups of negative precharging switches from a first negative precharging switch NSW1 to a k-th negative precharging switch NSWk. Accordingly, the signal line drive circuit 53 can supply the precharging signals VPRC and image signals to the n signal lines 23.

First, the n signal lines 23 are divided into k groups of the signal lines. That is, there are k types of image sequence signals, and thus the n signal lines 23 are divided into the k groups of the signal lines from a first sequence signal line (referred to as a first sequence signal line group) to a k-th sequence signal line (referred to as a k-th sequence signal line group). In the signal line Sjk+p of the (jk+p)-th column, any value between one and k is taken for p, and the signal line Sjk+p of the (jk+p)-th column belongs to a p sequence signal line group. Any integer value between zero and q can be taken for the parameter j. The numerical value q is a maximum value of the parameter j, and is a value (q=n/k−1) that is obtained by subtracting 1 from a value that is obtained by dividing the number of signal lines 23 *n* by the sequence number k. In the embodiment, since n is equal to 4112, and k is equal to four as an example, the parameter j can take the maximum value q of 1027 (q=1027). Accordingly, the first sequence signal line group is an aggregate of signal lines Sjk+1 of the (jk+1)-th row. Specifically, the first sequence signal line group includes a number of 1028 of the signal lines 23 from a signal line S1 of the first row at j=0; a signal line S5 of the fifth row at j=1; a signal line S9 of the ninth row at j=2; . . . and up to a signal line S4109 of the 4109th row at j=1027. Similarly, a second sequence signal line group is an aggregate of signal lines Sjk+2 of the (jk+2)-th row. Specifically, the second sequence signal line group includes a number of 1028 of the signal lines 23 from a signal line S2 of the second row at j=0; a signal line S6 of the sixth row at j=1; a signal line S10 of the tenth row at j=2; . . . and up to a signal line S4110 of the 4110th row at j=1027. Thereafter, similarly, the k-th sequence signal line group is an aggregate of signal lines Sjk+k of the (jk+k)-th row. Specifically, the k-th sequence signal line group includes a number of 1028 of the signal lines 23 from a signal line Sk of the k-th row at j=0; a signal line S2*k* of the 2k-th row at j=1; a signal line S3*k* of the 3k-th row at j=2; . . . and up to a signal line S(q+1)k (in this example, a signal line S4112 of the 4112th row at j=1028) of the ((q+1)k)-th row at j=q.

The following signal lines are wired in the image signal circuit 532: the k image sequence lines to correspond to the k types of the image sequence signals; and (q+1) original signal lines. A p-th image sequence signal SELp is supplied to the p-th image sequence line (p is an arbitrary integer between one and k). For example, a first image sequence signal SEL1 is supplied to the first image sequence line, a second image sequence signal SEL2 is supplied to the second image sequence line, and thereafter, similarly, a k-th image sequence signal SELk is supplied to the k-th image sequence line. A j-th original signal OSj is supplied to a j-th original signal line. For example, a zeroth original signal OS0 is supplied to a zeroth original signal line, a first original signal OS1 is supplied to a first original signal line, and thereafter, similarly, a q-th original signal OSq is supplied to a q-th original signal line. FIG. 4 illustrates the image signal circuit 532, the display region 42, and the precharging circuit 531 mainly associated with the signal lines 23 (from the signal line S1 of the first row to the signal line Sk of the k-th row) connected to the zeroth original signal line. The circuit configurations of the image signal circuit 532, the display region 42, and the precharging circuit 531 associated with the following signal lines 23 are the same as those associated with the signal lines 23 connected to the zeroth original signal line: from the signal lines 23 (from the signal line Sk+1 of the (k+1)-th row to the signal line S2*k* of the 2k-th row) connected to the first original signal line, to the signal lines 23 (from the signal line Sqk+1 of the (gk+1)-th row to the signal line S(q+1)k of the ((q+1)k)-th row) connected to the q-th original signal line.

The image signal circuit 532 includes the (q+1) (that is, n/k) first switches SW1 to the (q+1) (that is, n/k) k-th switches SWk. Similar to the pixel transistor 24, each of the first switches SW1 to the k-th switches SWk is formed by a thin film transistor. One end (one of a source and a drain) of a p-th switch SWp is electrically connected to the signal line Sjk+p of the (jk+p)-th row, the other end (the other of the source and the drain) of the p-th switch SWp is electrically connected to the j-th original signal line, and a gate of the p-th switch SWp is electrically connected to the p-th image sequence line. Accordingly, when the p-th image sequence signal SELp is a selected signal, the p-th switch SWp is turned on, and the j-th original signal OSj as an image signal is supplied to the signal line Sjk+p of the (jk+p)-th row. For example, the first switch SW1 is disposed between the zeroth original signal line and the signal line S1 of the first row belonging to the first sequence signal line group, and a gate of the first switch SW1 is electrically connected to the first image sequence line. For this reason, when the first image sequence signal SEL1 is a selected signal, the first switch SW1 is turned on, and the zeroth original signal OS0 as an image signal is supplied to the signal line S1 of the first row. Similarly, for example, the fourth switch SW4 is disposed between the 1027th original signal line and the signal line S4112 of the 4112th row belonging to the fourth sequence signal line group, and a gate of the fourth switch SW4 is electrically connected to the fourth image sequence line. For this reason, when the fourth image sequence signal SEL4 is a selected signal, the fourth switch SW4 is turned on, and the 1027th original signal OS1027 as an image signal is supplied to the signal line S4112 of the 4112th row.

The following lines are wired in the precharging circuit 531: the k positive precharging sequence lines that correspond to k types of positive precharging sequence signals PPRC; the k negative precharging sequence lines that correspond to k types of negative precharging sequence signals NPRC; a positive precharging signal VPRC line through which a positive precharging signal VPRC+ is supplied; and a negative precharging signal VPRC line through which a negative precharging signal VPRC− is supplied.

A p-th positive precharging sequence signal PPRCp is supplied to a p-th positive precharging sequence line (p is an arbitrary integer between one and k). For example, a first positive precharging sequence signal PPRC1 is supplied to a first positive precharging sequence line, a second positive precharging sequence signal PPRC2 is supplied to a second precharging sequence signal line and thereafter, similarly, a k-th positive precharging sequence signal PPRCk is supplied to a k-th positive precharging sequence line. The positive precharging signal VPRC+ is supplied to the positive precharging signal VPRC line.

The precharging circuit 531 includes (q+1) (that is, n/k) of first positive precharging switches PSW1 to (q+1) (that is, n/k) k-th positive precharging switches PSWk. Similar to the pixel transistor 24, each of the first positive precharging switches PSW1 to the k-th positive precharging switches PSWk is formed by a thin film transistor. One end (one of a source and a drain) of a p-th positive precharging switch PSWp is electrically connected to the signal line Sjk+p of the (jk+p)-th row, the other end (the other of the source and the drain) of the p-th positive precharging switch PSWp is electrically connected to the positive precharging signal VPRC line, and a gate of the p-th positive precharging switch PSWp is electrically connected to the p-th positive precharging sequence line. Accordingly, when the p-th positive precharging sequence signal PPRCp is a selected signal, the p-th positive precharging switch PSWp is turned on, and the positive precharging signal VPRC+ is supplied to the signal line Sjk+p of the (jk+p)-th row. For example, the first positive precharging switch PSW1 is disposed between the positive precharging signal VPRC line and the signal line S1 of the first row belonging to the first sequence signal line group, and a gate of the first positive precharging switch PSW1 is electrically connected to the first positive precharging sequence line. For this reason, when the first positive precharging sequence signal PPRC1 is a selected signal, the first positive precharging switch PSW1 is turned on, and the positive precharging signal VPRC+ is supplied to the signal line S1 of the first row. Similarly, for example, the fourth positive precharging switch PSW4 is disposed between the positive precharging signal VPRC line and the signal line S4112 of the 4112th row belonging to the fourth sequence signal line group, and a gate of the fourth positive precharging switch PSW4 is electrically connected to the fourth positive precharging sequence line. For this reason, when the fourth positive precharging sequence signal PPRC4 is a selected signal, the fourth positive precharging switch PSW4 is turned on, and the positive precharging signal VPRC+ is supplied to the signal line S4112 of the 4112th row.

A p-th negative precharging sequence signal NPRCp is supplied to a p-th negative precharging sequence line (p is an arbitrary integer between one and k). For example, a first negative precharging sequence signal NPRC1 is supplied to first negative precharging sequence lines, a second negative precharging sequence signal NPRC2 is supplied to second precharging sequence signal lines, and thereafter, similarly, a k-th negative precharging sequence signal NPRCk is supplied to k-th negative precharging sequence lines. The negative precharging signal VPRC− is supplied to the negative precharging signal VPRC line.

The precharging circuit 531 includes (q+1) (that is, n/k) first negative precharging switches NSW1 to (q+1) (that is, n/k) k-th negative precharging switches NSWk. Similar to the pixel transistor 24, each of the first negative precharging switches NSW1 to the k-th negative precharging switches NSWk is formed by a thin film transistor. One end (one of a source and a drain) of a p-th negative precharging switch NSWp is electrically connected to the signal line Sjk+p of the (jk+p)-th row, the other end (the other of the source and the drain) of the p-th negative precharging switch NSWp is electrically connected to the negative precharging signal VPRC line, and a gate of the p-th negative precharging switch NSWp is electrically connected to the p-th negative precharging sequence line. Accordingly, when the p-th negative precharging sequence signal NPRCp is a selected signal, the p-th negative precharging switch NSWp is turned on, and the negative precharging signal VPRC− is supplied to the signal line Sjk+p of the (jk+p)-th row. For example, the first negative precharging switch NSW1 is disposed between the negative precharging signal VPRC line and the signal line S1 of the first row belonging to the first sequence signal line group, and a gate of the first negative precharging switch NSW1 is electrically connected to the first negative precharging sequence line. For this reason, when the first negative precharging sequence signal NPRC1 is a selected signal, the first negative precharging switch NSW1 is turned on, and the negative precharging signal VPRC− is supplied to the signal line S1 of the first row. Similarly, for example, the fourth negative precharging switch NSW4 is disposed between the negative precharging signal VPRC line and the signal line S4112 of the 4112th row belonging to the fourth sequence signal line group, and a gate of the fourth negative precharging switch NSW4 is electrically connected to the fourth negative precharging sequence line. For this reason, when the fourth negative precharging sequence signal NPRC4 is a selected signal, the fourth negative precharging switch NSW4 is turned on, and the negative precharging signal VPRC− is supplied to the signal line S4112 of the 4112th row.

In this specification, a terminal 1 and a terminal 2 being electrically connected to each other indicates that the terminals 1 and 2 can have the same logic state (potential from design perspective). Specifically, the terminals 1 and 2 may not only be directly connected to each other via wiring, but also may be connected to each other via a resistor element, a switching element, or the like. That is, even though the potential of the terminal 1 is slightly different from that of the terminal 2, the terminals 1 and 2 in the same logic state on a circuit are assumed to be electrically connected to each other. Accordingly, for example, as illustrated in FIG. 4, even when the first switch SW1 is disposed between the signal line S1 of the first row and the zeroth original signal line, the zeroth original signal OS0 is supplied to the signal line S1 of the first row when the first switch SW1 is turned on, and thus the signal line S1 of the first row is electrically connected to the zeroth original signal line.

Drive Method

Figure 5:
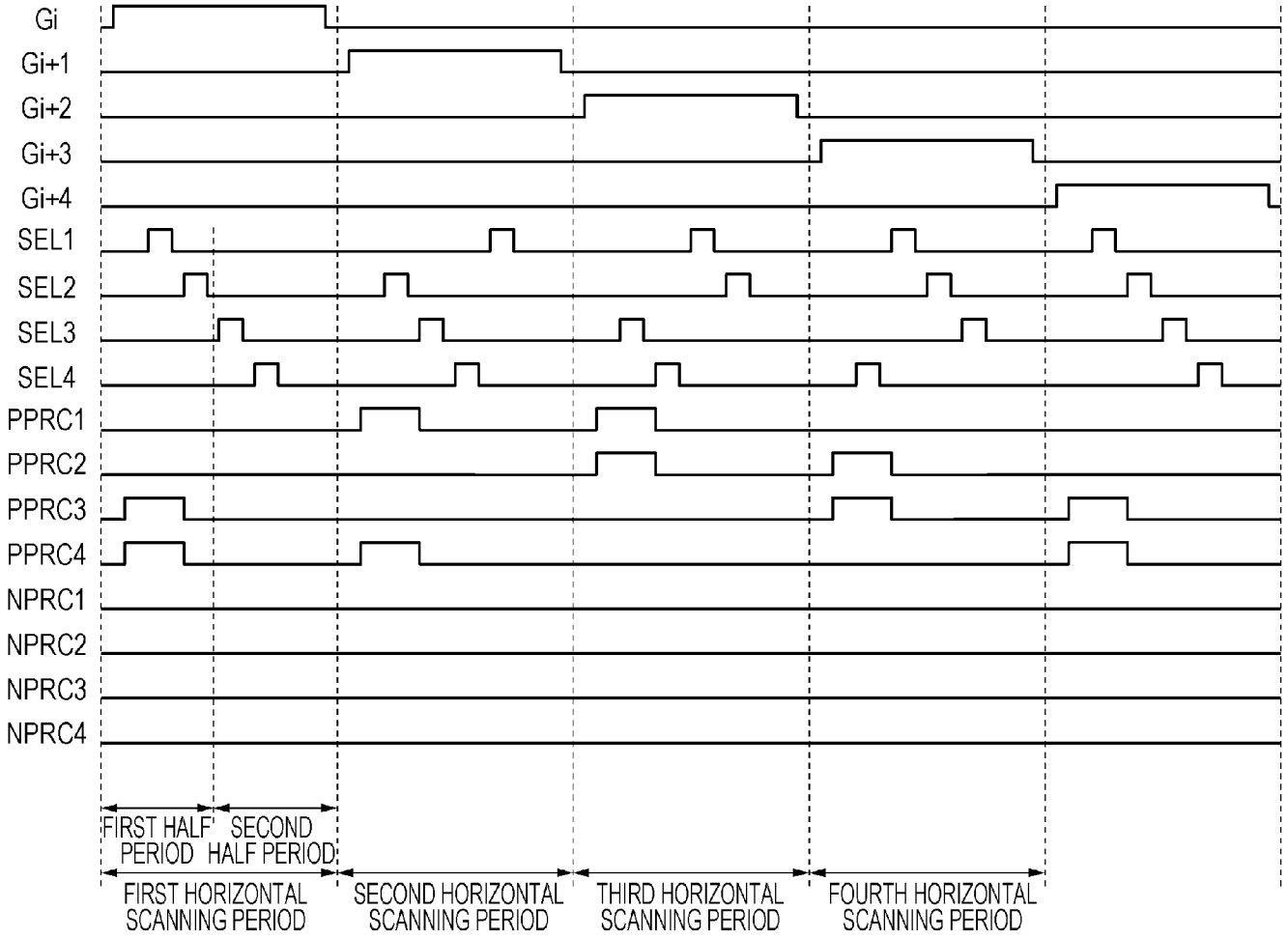
FIG. 5 is an example of a timing chart illustrating a drive method according to the first embodiment.
Figure 6:
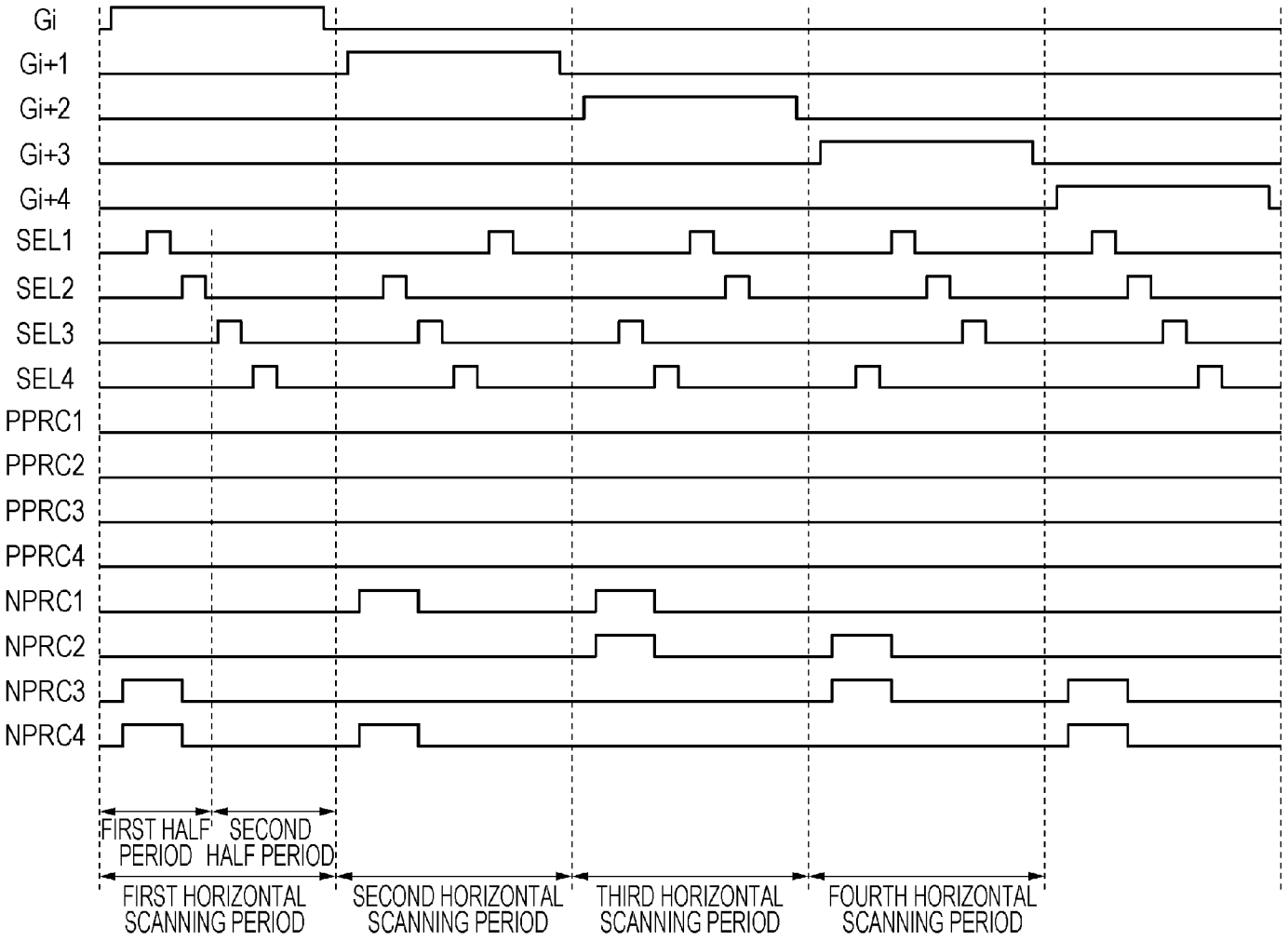
FIG. 6 is an example of a timing chart illustrating the drive method according to the first embodiment.
Figure 15:
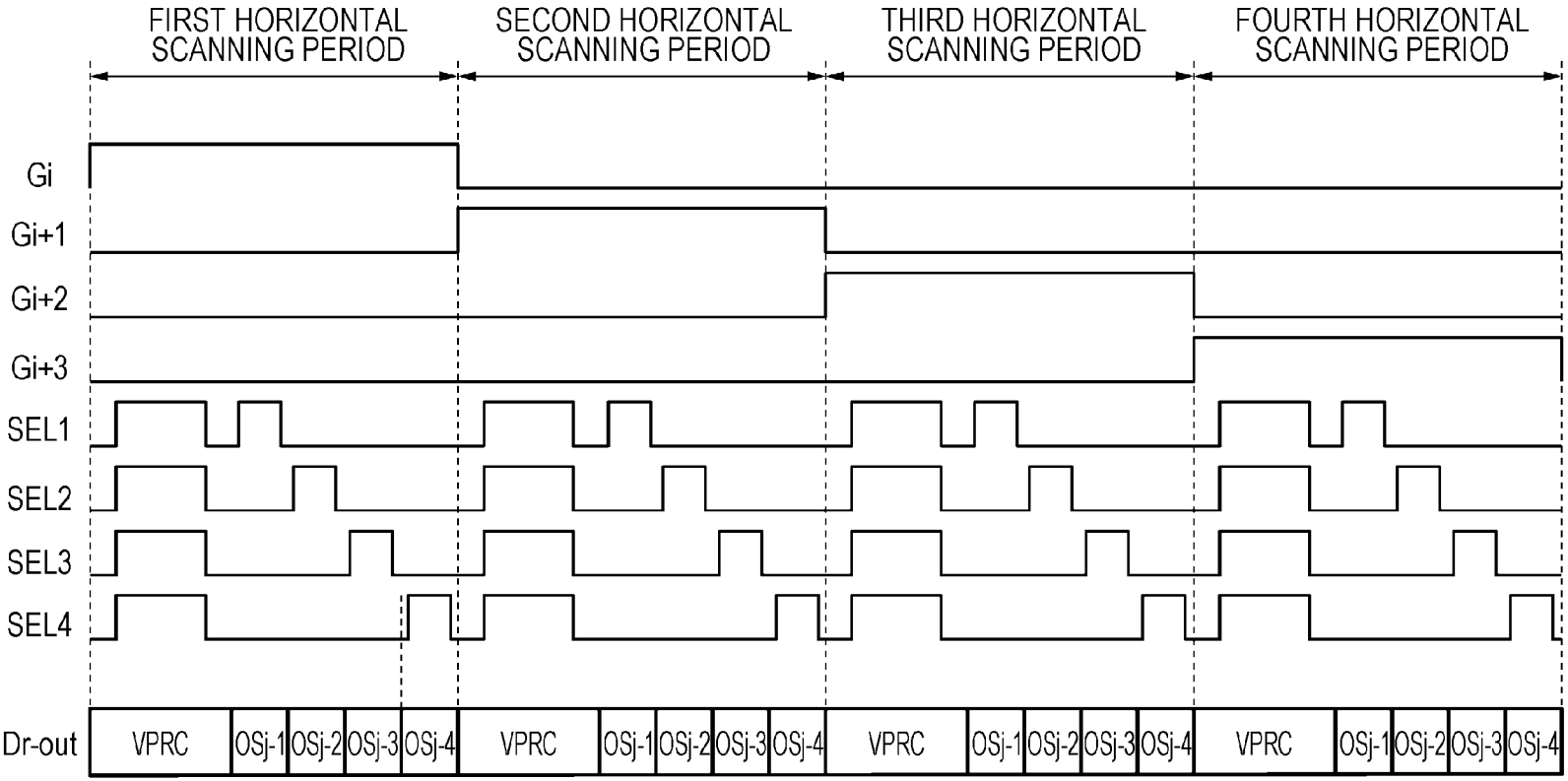
FIG. 15 is a timing chart illustrating a comparative example.

FIG. 5 is an example of a timing chart illustrating a drive method according to the first embodiment, and illustrates a timing chart for positive polarity driving. FIG. 6 is an example of a timing chart illustrating the drive method according to the first embodiment, and illustrates a timing chart for negative polarity driving. Subsequently, a method of driving the electro-optical apparatus 20 with the above-mentioned configuration will be described with reference to FIGS. 5, 6, and 15. FIG. 15 is a timing chart illustrating a comparative example, but for illustrative purposes, the same signs and designations are assigned to the same types of signals as in the embodiment.

The electro-optical apparatus 20 is operated by a polarity reversal drive method so as to prevent the electrical deterioration of an electro-optical material. The polarity reversal drive method is a drive method by which the electric field between the pixel electrode 25 and the common electrode 27 is reversed after each of constant periods. Specifically, the polarity reversal drive method is a drive method by which the potential (pixel potential) of the pixel electrode 25 is swung positively and negatively with respect to the potential (common potential) of the common electrode 27. The positive polarity drive method is a drive method by which an image signal is formed in such a manner that the pixel potential is higher than the common potential, and a negative polarity drive method is a drive method by which an image signal is formed in such a manner that the pixel potential is lower than the common potential. The positive precharging signal VPRC+ is supplied to the signal lines 23 at the positive polarity driving of the electro-optical apparatus 20, and the negative precharging signal VPRC− is supplied to the signal lines 23 at the negative polarity driving. FIG. 5 illustrates scanning signals, image sequence signals SEL, positive precharging sequence signals PPRC, and negative precharging sequence signals NPRC, all of which are supplied to the electro-optical apparatus 20 at the positive polarity driving. FIG. 6 illustrates scanning signals, image sequence signals SEL, positive precharging sequence signals PPRC, and negative precharging sequence signals NPRC, all of which are supplied to the electro-optical apparatus 20 at the negative polarity driving. FIGS. 5 and 6 illustrate the scanning signals as examples of the scanning signal, which are supplied to the scanning lines from a scanning line Gi of the i-th column to a scanning line Gi+4 of the (i+4)-th column. In the embodiment, a period of the polarity reversal driving is a frame period, and the polarities are reversed each frame.

One vertical scanning period includes the m horizontal scanning periods, and includes at least a first horizontal scanning period. As illustrated in FIGS. 5 and 6, when the drive unit 50 supplies image signals to the k signal line groups in the first horizontal scanning period, the drive unit 50 supplies the precharging signals VPRC to a part of the k signal line groups and then supplies image signals thereto, and in contrast, the drive unit 50 supplies image signals to the remainder of the k signal line groups without supplying the precharging signals VPRC thereto. In contrast, as illustrated in FIG. 15, in the comparative example of the related art, the precharging signal VPRC is supplied to the entirety of the signal lines 23 in the entirety of the horizontal scanning periods. The drive method of the embodiment illustrated in FIGS. 5 and 6 prevents the occurrence of crosstalk, which will be described later. Since the drive method reduces the frequency of precharging operations, power consumption is also reduced. Accordingly, a heat quantity is reduced, thereby improving the operational stability of the electro-optical apparatus 20. That is, it is possible to realize the electro-optical apparatus 20 that stably displays a high-definition image having reduced crosstalk with low power consumption.

First, the positive polarity drive method will be described with reference to FIG. 5. At the positive polarity driving, the entirety of the negative precharging sequence signals NPRC have a non-selection state at all times, and a part of the positive precharging sequence signals PPRC have a selection state.

In the first horizontal scanning period, when the precharging signals VPRC are supplied, at least one of the first positive precharging sequence signal PPRC1 to the k-th positive precharging sequence signal PPRCk becomes a non-selected signal. For example, in a case where the first horizontal scanning period is a horizontal scanning period in which a scanning line Gi of the i-th column is selected, when the precharging signals VPRC are supplied in this horizontal scanning period, the precharging signals VPRC are supplied to only two signal line groups (the third and fourth sequence signal line groups in this example) among the k signal line groups, and not to the remaining two signal line groups (the first and second signal line groups in this example). Specifically, in a period (one partial period of a horizontal scanning period, and referred to as a first half period) of a horizontal scanning period, in which the precharging signals VPRC are supplied to a part of the k signal line groups, image signals are supplied to the other part of the k signal line groups. In a period (the other partial period of the horizontal scanning period, and referred to as a second half period) subsequent to the first half period of the horizontal scanning period, image signals are supplied to the part of the k signal line groups, to which the precharging signals VPRC are supplied. For this reason, when image signals are supplied to the k signal line groups in the horizontal scanning period, the precharging signals VPRC and the image signals are respectively supplied to the part of the k signal line groups in the first and second half periods. In contrast, in the first half period, the image signals are supplied to the remainder of the k signal line groups without the precharging signals VPRC being supplied thereto. In practice, in the first half period of the first horizontal scanning period in which the scanning line Gi of the i-th column is selected, the third positive precharging sequence signal PPRC3 and the fourth positive precharging sequence signal PPRC4 have a selection state, and the positive precharging signals VPRC+ are supplied to a signal line Sjk+3 of the (jk+3)-th row and a signal line Sjk+4 of the (jk+4)-th row. The first positive precharging sequence signal PPRC1, the second positive precharging sequence signal PPRC2, and the entirety of the negative precharging sequence signals NPRC have a non-selection state. In the first half period of the first horizontal scanning period, the first image sequence signal SEL1 and the second image sequence signal SEL2 have a selection state in time-series sequence, the j-th original signal OSj as a first sequence image signal is supplied to the signal line Sjk+1 of the (jk+1)-th row, and subsequently, the j-th original signal OSj as a second sequence image signal is supplied to the signal line Sjk+2 of the (jk+2)-th row. In the second half period of the first horizontal scanning period, the entirety of the precharging sequence signals PRC (the entirety of the positive precharging sequence signals PPRC and the entirety of the negative precharging sequence signals NPRC) have a non-selection state, and the precharging signal VPRC is not supplied to any one of the signal lines 23. At this time, the third image sequence signal SEL3 and the fourth image sequence signal SEL4 have a selection state in time-series sequence, the j-th original signal OSj as a third sequence image signal is supplied to the signal line Sjk+3 of the (jk+3)-th row, and subsequently, the j-th original signal OSj as a fourth sequence image signal is supplied to the signal line Sjk+4 of the (jk+4)-th row.

It is preferable that one vertical scanning period further include a second horizontal scanning period. The second horizontal scanning period is subsequent to the first horizontal scanning period. In the second horizontal scanning period, the drive unit 50 supplies the precharging signals VPRC to a part of the k signal line groups and then supplies image signals thereto, and in contrast, the drive unit 50 supplies image signals to the remainder of the k signal line groups without supplying the precharging signals VPRC thereto. At this time, in the second horizontal scanning period, the precharging signals VPRC are supplied to the signal lines 23 that are different from those in the first horizontal scanning period. Since in the second horizontal scanning period, the precharging signals VPRC are supplied to the signal lines 23 that are different from those in the first horizontal scanning period, it is possible to reduce the frequency of precharging operations, and change the signal lines, to which the precharging signals VPRC are supplied, between the first and second horizontal scanning periods.

Even in the second horizontal scanning period, when the positive precharging sequence signals PPRC are supplied, at least one of the first positive precharging sequence signal PPRC1 to the k-th positive precharging sequence signal PPRCk becomes a non-selected signal. At this time, the precharging sequence signals set to the non-selected signals in the first horizontal scanning period are different from those in the second horizontal scanning period. In this example, the second horizontal scanning period is a horizontal scanning period in which a scanning line Gi+1 of the (i+1)-th column is selected, and in this horizontal scanning period, when the precharging signals VPRC are supplied, the precharging signals VPRC are supplied to only two signal line groups (the fourth and first sequence signal line groups in this example) among the k signal line groups, and not to the remaining two signal line groups (the second and third signal line groups in this example). That is, even in a first half period of the second horizontal scanning period, the precharging signals VPRC are supplied to a part of the k signal line groups, and image signals are supplied to the other part of the k signal line groups. In a second half period of the horizontal scanning period, image signals are supplied to the part of the k signal line groups, to which the precharging signals VPRC are supplied. For this reason, when image signals are supplied to the k signal line groups in the horizontal scanning period, the precharging signals VPRC and the image signals are respectively supplied to the part of the k signal line groups in the first and second half period. In contrast, in the first half period, the image signals are supplied to the remainder of the k signal line groups without the precharging signals VPRC being supplied thereto. At this time, the signal lines to which the precharging signals VPRC are supplied are changed between the first horizontal scanning period and the second horizontal scanning period. In practice, in the first half period of the second horizontal scanning period, the fourth positive precharging sequence signal PPRC4 and the first positive precharging sequence signal PPRC1 have a selection state, and the positive precharging signals VPRC+ are supplied to the signal line Sjk+4 of the (jk+4)-th row and a signal line Sjk+1 of the (jk+1)-th row. The second positive precharging sequence signal PPRC2, the third positive precharging sequence signal PPRC3, and the entirety of the negative precharging sequence signals NPRC have a non-selection state. In the first half period of the second horizontal scanning period, the second image sequence signal SEL2 and the third image sequence signal SEL3 have a selection state in time-series sequence, the j-th original signal OSj as the second sequence image signal is supplied to the signal line Sjk+2 of the (jk+2)-th row, and subsequently, the j-th original signal OSj as the third sequence image signal is supplied to the signal line Sjk+3 of the (jk+3)-th row. In the second half period of the second horizontal scanning period, the entirety of the precharging sequence signals PRC (the entirety of the positive precharging sequence signals PPRC and the entirety of the negative precharging sequence signals NPRC) have a non-selection state, and the precharging signal VPRC is not supplied to any one of the signal lines 23. At this time, the fourth image sequence signal SEL4 and the first image sequence signal SEL1 have a selection state in time-series sequence, the j-th original signal OSj as the fourth sequence image signal is supplied to the signal line Sjk+4 of the (jk+4)-th row, and subsequently, the j-th original signal OSj as the first sequence image signal is supplied to the signal line Sjk+1 of the (jk+1)-th row.

It is most preferable that one vertical scanning period include at least the k horizontal scanning periods from the first horizontal scanning period to a k-th horizontal scanning period. It is most preferable that in each of the k horizontal scanning periods from the first to k-th horizontal scanning periods, after the precharging signal VPRC is supplied to a part of the k signal line groups, image signals be supplied thereto, image signals be supplied to the remainder of the k signal line groups without the precharging signals VPRC being supplied thereto, and the precharging signal VPRC be supplied to each of the k numbers of the signal line groups the same times in the first to k-th horizontal scanning periods. In other words, it is preferable that one vertical scanning period include at least the k horizontal scanning periods from the first to k-th horizontal scanning periods. It is preferable that in each of the first to k-th horizontal scanning periods, in the first half period in which the precharging signals VPRC are supplied to a part of the k signal line groups, the drive unit 50 supply the image signals to the other part of the k signal line groups, and in the second half period subsequent to the first half period, the drive unit 50 supply the image signals to the part of the k signal line groups, to which the precharging signals VPRC are supplied, thereby supplying the precharging signals VPRC to the entirety of the k signal line groups in the first to k-th horizontal scanning periods. In this manner, the frequency of precharging operations is reduced, and the precharging signals VPRC are supplied to the entirety of the signal lines.

In the embodiment, k is equal to four, and as illustrated in FIG. 5, one vertical scanning period includes four horizontal scanning periods from the first to four horizontal scanning periods. The first horizontal scanning period is a scanning period in which the scanning line Gi of the i-th column is selected, the second horizontal scanning period is a scanning period in which the scanning line Gi+1 of the (i+1)-th column is selected, the third horizontal scanning period is a scanning period in which the scanning line Gi+2 of the (i+2)-th column is selected, and the fourth horizontal scanning period is a scanning period in which the scanning line Gi+3 of the (i+3)-th column is selected. In each of the four horizontal scanning periods, the positive precharging signals VPRC+ are supplied to a part (two signal line groups in the embodiment) of the four signal line groups, and then image signals are supplied thereto, and image signals are supplied to the remainder of the four signal line groups without the positive precharging signal VPRC+ being supplied thereto. In other words, in the first half period of each of the four horizontal scanning periods, the positive precharging signals VPRC+ are supplied to the part (two signal line groups in the embodiment) of the four signal line groups, and the image signals are supplied to the remainder of the four signal line groups, and in the second half period, the image signals are supplied to the part of the four signal line groups, to which the positive precharging signals VPRC+ are supplied. At this time, since the signal line groups to which the positive precharging signals VPRC+ are supplied are changed each horizontal scanning period, the positive precharging signal VPRC+ is supplied to each of the four signal line groups the same times in the first to fourth horizontal scanning periods. In the embodiment, the positive precharging signal VPRC+ is supplied to each of the four signal line groups two times in the four horizontal scanning periods. Thereafter, a cycle from the first to fourth horizontal scanning periods is repeated with respect to the entirety of the horizontal scanning periods. In this specification, the precharging operation refers to the fact that the precharging signal VPRC is supplied to the signal line 23.

As illustrated in FIG. 5, it is preferable that different signal line groups undergo the precharging operation each horizontal scanning period, and the signal line groups go through the precharging operations once in the horizontal scanning periods, the frequency of which is I (I is a value greater than zero) times the number of signal line groups k. In brief, it is preferable that the precharging operation be executed for each of the signal line groups on each of kI horizontal scanning periods. In the embodiment, the precharging operation is executed for each of the signal lines 23 every four horizontal scanning periods, at a frequency which is 0.5 (I=0.5) times the number (k=4) of signal line groups. The reason for this is because the occurrence of crosstalk is prevented even though the precharging operation is not executed in one horizontal scanning period, which will be described later. Since a drive load (capacitance for signal potential in a selection state) of the control apparatus 30 under the precharging operation is reduced compared to the configuration of the related art, power consumption is also reduced.

Subsequently, the negative polarity drive method will be described with reference to FIG. 6. The negative polarity drive method is the same as the positive polarity drive method that is described with reference to FIG. 5. That is, at the negative polarity driving, the entirety of the positive precharging sequence signals PPRC have a non-selection state at all times, and a part of the negative precharging sequence signals NPRC have a selection state.

As illustrated in FIG. 6, in the first horizontal scanning period, when the precharging signals VPRC are supplied, at least one of the first negative precharging sequence signal NPRC1 to the k-th negative precharging sequence signal NPRCk becomes a non-selected signal. That is, when the precharging signals VPRC are supplied, the precharging signals VPRC are supplied to only two signal line groups (the third and fourth sequence signal line groups in the first horizontal scanning period) among the k signal line groups, and not to the remaining two signal line groups (the first and second signal line groups in the first horizontal scanning period). For example, in the first half period of the first horizontal scanning period in which the scanning line Gi of the i-th column is selected, the third negative precharging sequence signal NPRC3 and the fourth negative precharging sequence signal NPRC4 have a selection state, and the negative precharging signals VPRC− are supplied to the signal line Sjk+3 of the (jk+3)-th row and the signal line Sjk+4 of the (jk+4)-th row. The first negative precharging sequence signal NPRC1, the second negative precharging sequence signal NPRC2, and the entirety of the positive precharging sequence signals PPRC have a non-selection state. In the first half period of the first horizontal scanning period, the first image sequence signal SEL1 and the second image sequence signal SEL2 have a selection state in time-series sequence, the j-th original signal OSj as the first sequence image signal is supplied to the signal line Sjk+1 of the (jk+1)-th row, and subsequently, the j-th original signal OSj as the second sequence image signal is supplied to the signal line Sjk+2 of the (jk+2)-th row. In the second half period of the first horizontal scanning period, the entirety of the precharging sequence signals PRC (the entirety of the negative precharging sequence signals NPRC and the entirety of the positive precharging sequence signals PPRC) have a non-selection state, and the precharging signal VPRC is not supplied to any one of the signal lines 23. At this time, the third image sequence signal SEL3 and the fourth image sequence signal SEL4 have a selection state in time-series sequence, the j-th original signal OSj as the third sequence image signal is supplied to the signal line Sjk+3 of the (jk+3)-th row, and subsequently, the j-th original signal OSj as the fourth sequence image signal is supplied to the signal line Sjk+4 of the (jk+4)-th row.

Even in the second horizontal scanning period, when the negative precharging sequence signals NPRC are supplied, at least one of the first negative precharging sequence signal NPRC1 to the k-th negative precharging sequence signal NPRCk becomes a non-selected signal. At this time, the precharging sequence signals set to the non-selected signals in the first horizontal scanning period are different from those in the second horizontal scanning period. In this example, the second horizontal scanning period is a horizontal scanning period in which the scanning line Gi+1 of the (i+1)-th column is selected, and in this horizontal scanning period, when the precharging signals VPRC are supplied, the precharging signals VPRC are supplied to only two signal line groups (the fourth and first sequence signal line groups in this example) among the k signal line groups, and not to the remaining two signal line groups (the second and third signal line groups in this example). At this time, the signal lines to which the precharging signals VPRC are supplied are changed between the first horizontal scanning period and the second horizontal scanning period. In practice, in the first half period of the second horizontal scanning period, the fourth negative precharging sequence signal NPRC4 and the first negative precharging sequence signal NPRC1 have a selection state, and the negative precharging signals VPRC− are supplied to the signal line Sjk+4 of the (jk+4)-th row and the signal line Sjk+1 of the (jk+1)-th row. The second negative precharging sequence signal NPRC2, the third negative precharging sequence signal NPRC3, and the entirety of the positive precharging sequence signals PPRC have a non-selection state. In the first half period of the second horizontal scanning period, the second image sequence signal SEL2 to the third image sequence signal SEL3 have a selection state in time-series sequence, the j-th original signal OSj as the second sequence image signal is supplied to the signal line Sjk+2 of the (jk+2)-th row, and subsequently, the j-th original signal OSj as the third sequence image signal is supplied to the signal line Sjk+3 of the (jk+3)-th row. In the second half period of the second horizontal scanning period, the entirety of the precharging sequence signals PRC (the entirety of the negative precharging sequence signals NPRC and the entirety of the positive precharging sequence signals PPRC) have a non-selection state, and the precharging signal VPRC is not supplied to any one of the signal lines 23. At this time, the fourth image sequence signal SEL4 and the first image sequence signal SEL1 have a selection state in time-series sequence, the j-th original signal OSj as the fourth sequence image signal is supplied to the signal line Sjk+4 of the (jk+4)-th row, and subsequently, the j-th original signal OSj as the first sequence image signal is supplied to the signal line Sjk+1 of the (jk+1)-th row.

In the embodiment, k is equal to four, and as illustrated in FIG. 6, one vertical scanning period includes four horizontal scanning periods from the first to four horizontal scanning periods. The first horizontal scanning period is a scanning period in which the scanning line Gi of the i-th column is selected, the second horizontal scanning period is a scanning period in which the scanning line Gi+1 of the (i+1)-th column is selected, the third horizontal scanning period is a scanning period in which the scanning line Gi+2 of the (i+2)-th column is selected, and the fourth horizontal scanning period is a scanning period in which the scanning line Gi+3 of the (i+3)-th column is selected. In each of the four horizontal scanning periods, the negative precharging signals VPRC− are supplied to a part (two signal line groups in the embodiment) of the four signal line groups, and then image signals are supplied thereto, and image signals are supplied to the remainder of the four signal line groups without the negative precharging signal VPRC− being supplied thereto. In other words, in the first half period of each of the four horizontal scanning periods, the negative precharging signals VPRC− are supplied to the part (two signal line groups in the embodiment) of the four signal line groups, and the image signals are supplied to the remainder of the four signal line groups, and in the second half period, the image signals are supplied to the part of the four signal line groups, to which the negative precharging signals VPRC− are supplied. At this time, since the signal line groups to which the negative precharging signals VPRC− are supplied are changed each horizontal scanning period, the negative precharging signal VPRC− is supplied to each of the four signal line groups the same times in the first to fourth horizontal scanning periods. In the embodiment, the negative precharging signal VPRC− is supplied to each of the four signal line groups two times in the four horizontal scanning periods. Thereafter, a cycle from the first to fourth horizontal scanning periods is repeated with respect to the entirety of the horizontal scanning periods.

Crosstalk

In the related art, as illustrated in FIG. 15, the precharging signal VPRC was supplied to the entirety of the signal lines 23 once each horizontal scanning period. Accordingly, crosstalk was prevented from occurring in the vertical direction. The inventor of the present invention carried out in-depth research, and confirmed through experiments that the occurrence of crosstalk was prevented even though the precharging operation was not executed once in one horizontal scanning period. Subsequently, the description of the research will be given.

Figure 7A:
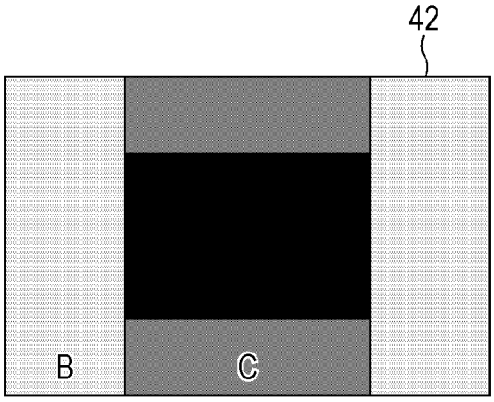
FIGS. 7A and 7B are graphs illustrating a relationship between the frequency of precharging operations and crosstalk.
Figure 7B:
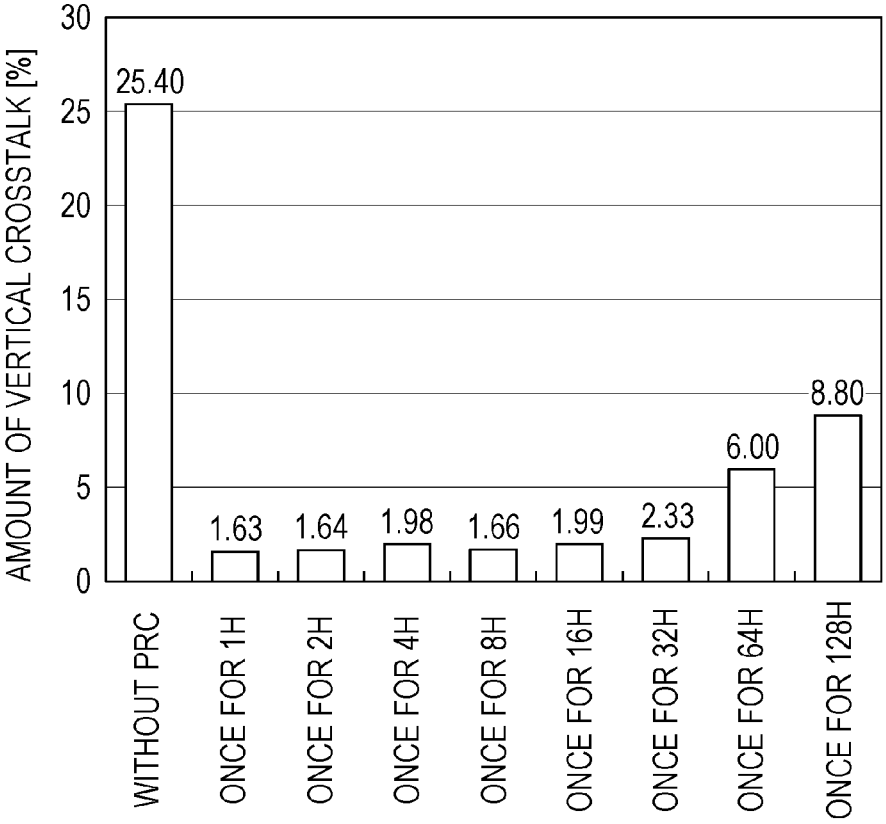

FIGS. 7A and 7B are graphs illustrating a relationship between the frequency of precharging operations and crosstalk, FIG. 7A illustrates a method of quantifying crosstalk, and FIG. 7B illustrates an example of evaluation results. As illustrated in FIG. 7A, a black window of a 50% width is displayed in a center portion of the display region 42, and the surrounding of the black window is set to a 10% gradient as background gradient luminance. The quantity of crosstalk refers to a ratio of a difference between background gradient luminance B and crosstalk portion luminance C with respect to the background gradient luminance B((B−C)/B×100). In the experiments, the quantity of crosstalk was measured while changing the frequency of precharging operations. FIG. 7B illustrates measurement results.

As illustrated in FIG. 7B, when the precharging operation is not executed (referred to as "without the execution of the PRC operation" in FIG. 7B), the quantity of crosstalk of approximately 25% was measured. When the precharging operation was executed once in each of one horizontal scanning period (equivalent to the case of the related art, and referred to as "once in 1H" in FIG. 7B) to 32 horizontal scanning periods (referred to as "once in 32H" in FIG. 7B), the quantity of crosstalk was approximately 2% for all of the horizontal scanning periods, and the occurrence of crosstalk was prevented to the same extent. When the frequency of precharging operation was set to be less than once in 32 horizontal scanning periods, it was observed that the quantity of crosstalk tended to gradually increase. For example, when the precharging operation was executed once (referred to as "once in 64H" in FIG. 7B) in 64 horizontal scanning periods, the quantity of crosstalk increased by approximately 6%. When the quantity of crosstalk exceeds approximately 3%, crosstalk can be recognized by many people, and thus when the quantity of crosstalk is less than 3%, a high-quality image can be obtained.

Accordingly, the drive unit 50 supplies the precharging signal VPRC to each of the k signal line groups multiple times during one vertical scanning period, and a period between the supply of the precharging signal VPRC, and the supply of the subsequent precharging signal VPRC is set to 32 horizontal scanning periods or less so as to display a high-quality image. As illustrated in FIG. 7B, in this manner, the occurrence of crosstalk is prevented.

As described above, the signal line groups go through the precharging operations once in the horizontal scanning periods, the frequency of which is the I times the number of signal line groups k. That is, the precharging operation is executed once for each of the signal lines 23 on each of kI horizontal scanning periods. At this time, as illustrated in FIG. 7B, the value of the kI is set to be greater than one and less than 32. That is, the precharging operation is not executed in the entirety of the horizontal scanning periods (1<kI), and is executed at least once in 32 horizontal scanning periods (kI≤32). For this reason, it is preferable that one vertical scanning period include horizontal scanning periods in which only image signals are supplied to the entirety of the k signal line groups without the precharging signals VPRC being supplied thereto. For example, when the precharging operation is executed once in 16 horizontal scanning periods (kI=16, here k=4 and I=4 in this example), as illustrated in FIG. 5, the precharging signals VPRC are supplied only in the following four horizontal scanning periods among the 16 horizontal scanning periods: the first horizontal scanning period (a horizontal scanning period in which the precharging signal VPRC is supplied to only the first sequence signal line group); the second horizontal scanning period (a horizontal scanning period in which the precharging signal VPRC is supplied to only the second sequence signal line group); the third horizontal scanning period (a horizontal scanning period in which the precharging signal VPRC is supplied to only the third sequence signal line group); and the fourth horizontal scanning period (a horizontal scanning period in which the precharging signal VPRC is supplied to only the fourth sequence signal line group), and in contrast, in the remaining 12 horizontal scanning periods, only image signals are supplied to the entirety of the signal lines 23 without the precharging signals VPRC being supplied thereto. Since the vertical scanning period includes the horizontal scanning periods in which the precharging signals VPRC are not supplied, the frequency of precharging operations is reduced. In this manner, it is possible to reduce the occurrence of crosstalk, and realize low power consumption and high-speed driving.

As illustrated in the embodiment, the value of I may be less than one. In the embodiment, since I is equal to 0.5, and k is equal to four, the precharging signal VPRC is supplied to each of the signal lines 23 once in two horizontal scanning periods.

Precharging Period

It is possible to decrease a precharging period compared to a drive method of the related art illustrated in FIG. 15, using the method of driving the electro-optical apparatus 20 of the embodiment illustrated in FIGS. 5 and 6. This is because a drive load (capacitance for signal potential in a selection state) of the control apparatus 30 under the precharging operation is reduced to one kI-th (1/kI) when I is less than or equal to one, and one k-th (1/k) when I is greater than or equal to one, compared to the configuration of the related art, and thus a time constant (a constant obtained by multiplying wiring resistance and capacitance) of a target wiring for the precharging operation is reduced to approximately 1/kI to 1/k of that of the related art. Accordingly, theoretically, the precharging period can be reduced to approximately 1/kI to 1/k of that of the related art.

In contrast, it is possible to increase the precharging period compared to the drive method of the related art illustrated in FIG. 15, using the method of driving the electro-optical apparatus 20 of the embodiment illustrated in FIGS. 5 and 6. This is because the precharging operation is executed in a first half period of a horizontal scanning period, and in parallel with the precharging operation, image signals can be introduced to non-precharged signal line groups.

Accordingly, the drive unit 50 controls a period (precharging period) for the supply of the precharging signal VPRC, and a period (image period) for the supply of an image signal. For example, it is preferable that the drive unit 50 set the precharging period to be longer than of a first half period and the precharging period of a serial drive method, and at the same time, also set the image signal supply period to be longer than that of the serial drive method, compared to the serial drive method by which the precharging signals VPRC are supplied and subsequently image signals are supplied as illustrated in FIG. 15. In this manner, it is possible to accurately supply the precharging signal VPRC and an image signal to each pixel.

Other Electronic Equipment

The electro-optical apparatus 20 is driven by the above-mentioned drive method, and examples of the electronic equipment using the electro-optical apparatus 20 include a rear projection television receiver, a direct-view television receiver, a mobile phone, mobile audio equipment, a personal computer, a monitor of a video camera, a car navigation apparatus, a pager, an electronic organizer, an electronic calculator, a word processor, a workstation, a videophone, a POS terminal, a digital still camera, and the like, in addition to the projector illustrated with reference to FIG. 1.

Second Embodiment

Figure 8:
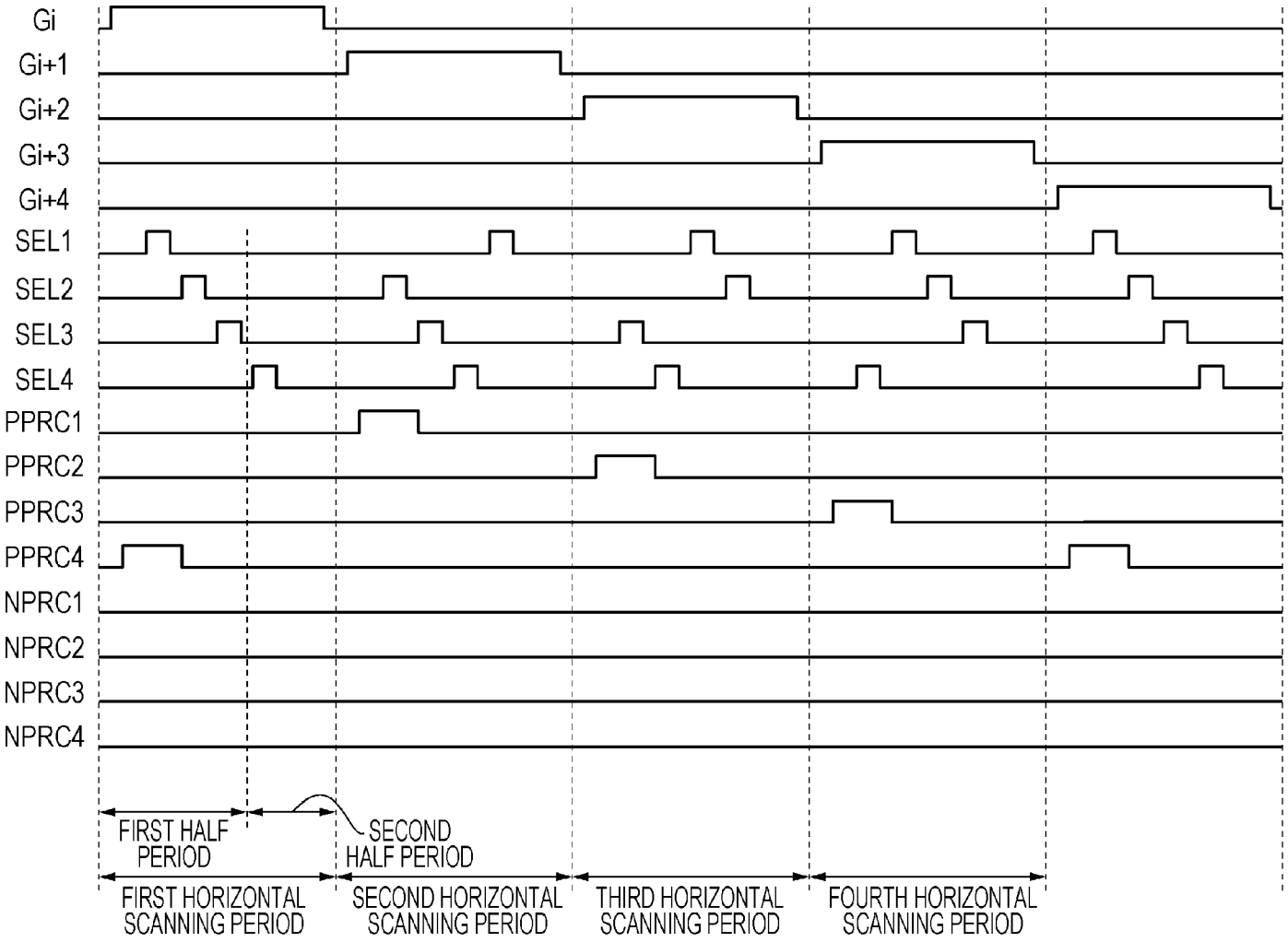
FIG. 8 is an example of a timing chart illustrating a drive method according to a second embodiment.
Figure 9:
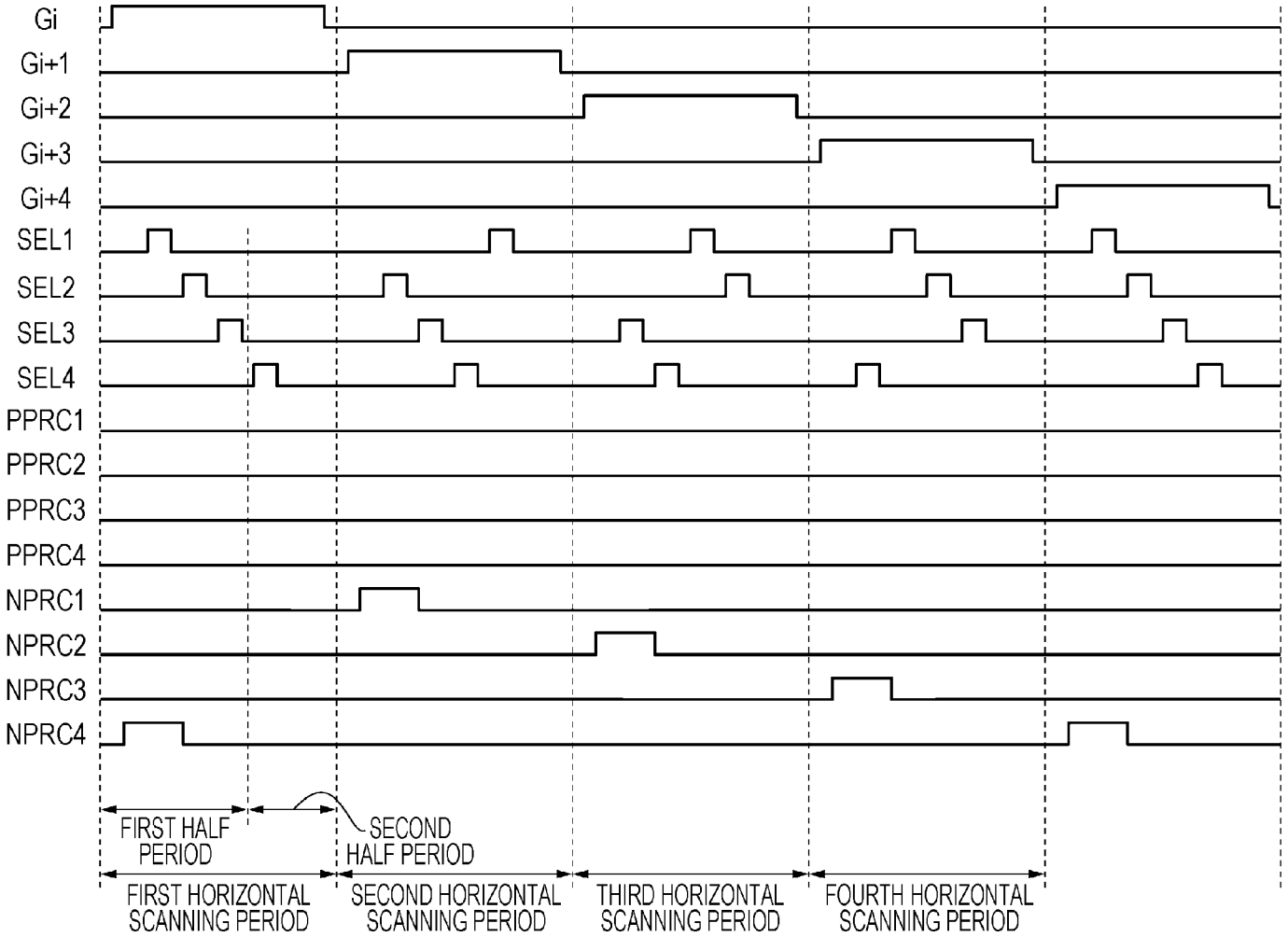
FIG. 9 is an example of a timing chart illustrating the drive method according to the second embodiment.

Embodiment 1—Frequency of Precharging Operations is Different in First Embodiment FIG. 8 is an example of a timing chart illustrating a drive method according to a second embodiment, and illustrates a timing chart for the positive polarity driving. FIG. 9 is an example of a timing chart illustrating the drive method according to the second embodiment, and illustrates a timing chart for the negative polarity driving. Subsequently, a method of driving the electro-optical apparatus 20 according to the second embodiment will be described with reference to FIGS. 8 and 9. The same reference signs will be assigned to the same configuration portions as in the first embodiment, and the descriptions thereof will not be repeated.

In the method of driving the electro-optical apparatus 20 of the embodiment illustrated in FIGS. 8 and 9, the frequency of precharging operations is different from that in the method of driving the electro-optical apparatus 20 of the first embodiment illustrated in FIGS. 5 and 6. Other configurations are substantially the same as the first embodiment.

In the method (refer to FIGS. 5 and 6) of driving the electro-optical apparatus 20 of the first embodiment, I is equal to 0.5, and the precharging operation is executed twice in four horizontal scanning periods. In contrast, in the method of driving the electro-optical apparatus 20 of this embodiment (refer to FIGS. 8 and 9), I is equal to one, and the precharging operation is executed once in four horizontal scanning periods.

First, the positive polarity drive method will be described with reference to FIG. 8. At the positive polarity driving, the entirety of the negative precharging sequence signals NPRC have a non-selection state, and a part of the positive precharging sequence signals PPRC have a selection state.

As illustrated in FIG. 8, in the first half period of the first horizontal scanning period in which the scanning line Gi of the i-th column is selected, the fourth positive precharging sequence signal PPRC4 has a selection state, and the positive precharging signal VPRC+ is supplied to the signal line Sjk+4 of the (jk+4)-th row. The first positive precharging sequence signal PPRC1, the second positive precharging sequence signal PPRC2, the third positive precharging sequence signal PPRC3, and the entirety of the negative precharging sequence signals NPRC have a non-selection state. In the first half period of the first horizontal scanning period, the first image sequence signal SEL1 to the third image sequence signal SEL3 have a selection state in time-series sequence, the j-th original signal OSj as the first sequence image signal is supplied to the signal line Sjk+1 of the (jk+1)-th row, the j-th original signal OSj as the second sequence image signal is supplied to the signal line Sjk+2 of the (jk+2)-th row, and subsequently, the j-th original signal OSj as the third sequence image signal is supplied to the signal line Sjk+3 of the (jk+3)-th row. In the second half period of the first horizontal scanning period, the entirety of the precharging sequence signals PRC (the entirety of the positive precharging sequence signals PPRC and the entirety of the negative precharging sequence signals NPRC) have a non-selection state, and the precharging signal VPRC is not supplied to any one of the signal lines 23. At this time, the fourth image sequence signal SEL4 has a selection state, and the j-th original signal OSj as the fourth sequence image signal is supplied to the signal line Sjk+4 of the (jk+4)-th row.

In the first half period of the second horizontal scanning period in which the scanning line Gi+1 of the (i+1)-th column is selected, the first positive precharging sequence signal PPRC1 has a selection state, and the positive precharging signal VPRC+ is supplied to the signal line Sjk+1 of the (jk+1)-th row. The second positive precharging sequence signal PPRC2, the third positive precharging sequence signal PPRC3, the fourth positive precharging sequence signal PPRC4, and the entirety of the negative precharging sequence signals NPRC have a non-selection state. In the first half period of the second horizontal scanning period, the second image sequence signal SEL2 to the fourth image sequence signal SEL4 have a selection state in time-series sequence, the j-th original signal OSj as the second sequence image signal is supplied to the signal line Sjk+2 of the (jk+2)-th row, the j-th original signal OSj as the third sequence image signal is supplied to the signal line Sjk+3 of the (jk+3)-th row, and subsequently, the j-th original signal OSj as the fourth sequence image signal is supplied to the signal line Sjk+4 of the (jk+4)-th row. In the second half period of the second horizontal scanning period, the entirety of the precharging sequence signals PRC (the entirety of the positive precharging sequence signals PPRC and the entirety of the negative precharging sequence signals NPRC) have a non-selection state, and the precharging signal VPRC is not supplied to any one of the signal lines 23. At this time, the first image sequence signal SEL1 has a selection state, the j-th original signal OSj as the first sequence image signal is supplied to the signal line Sjk+1 of the (jk+1)-th row, and subsequently, the j-th original signal OSj as the fourth sequence image signal is supplied to the signal line Sjk+1 of the (jk+1)-th row.

In the embodiment, k is equal to four, and as illustrated in FIG. 8, one vertical scanning period includes four horizontal scanning periods from the first to four horizontal scanning periods. The first horizontal scanning period is a scanning period in which the scanning line Gi of the i-th column is selected, the second horizontal scanning period is a scanning period in which the scanning line Gi+1 of the (i+1)-th column is selected, the third horizontal scanning period is a scanning period in which the scanning line Gi+2 of the (i+2)-th column is selected, and the fourth horizontal scanning period is a scanning period in which the scanning line Gi+3 of the (i+3)-th column is selected. In each of the four horizontal scanning periods, the positive precharging signals VPRC+ are supplied to a part (one signal line group in the embodiment) of the four signal line groups, and then image signals are supplied thereto, and image signals are supplied to the remainder of the four signal line groups without the positive precharging signal VPRC+ being supplied thereto. In other words, in the first half period of each of the four horizontal scanning periods, the positive precharging signals VPRC+ are supplied to the part (one signal line group in the embodiment) of the four signal line groups, and the image signals are supplied to the remainder of the four signal line groups, and in the second half period, the image signals are supplied to the part of the four signal line groups, to which the positive precharging signal VPRC+ is supplied. At this time, since the signal line group to which the positive precharging signal VPRC+ is supplied is changed each horizontal scanning period, the positive precharging signal VPRC+ is supplied to each of the four signal line groups the same times in the first to fourth horizontal scanning periods. In the embodiment, the positive precharging signal VPRC+ is supplied to each of the four signal line groups once in the four horizontal scanning periods. Thereafter, a cycle from the first to fourth horizontal scanning periods is repeated with respect to the entirety of the horizontal scanning periods.

Subsequently, the negative polarity drive method will be described with reference to FIG. 9. At the negative polarity driving, the entirety of the positive precharging sequence signals PPRC have a non-selection state at all times, and a part of the negative precharging sequence signals NPRC have a selection state.

As illustrated in FIG. 9, in the first half period of the first horizontal scanning period in which the scanning line Gi of the i-th column is selected, the fourth negative precharging sequence signal NPRC4 has a selection state, and the negative precharging signal VPRC− is supplied to the signal line Sjk+4 of the (jk+4)-th row. The first negative precharging sequence signal NPRC1, the second negative precharging sequence signal NPRC2, the third negative precharging sequence signal NPRC3, and the entirety of the positive precharging sequence signals PPRC have a non-selection state. In the first half period of the first horizontal scanning period, the first image sequence signal SEL1 to the third image sequence signal SEL3 have a selection state in time-series sequence, the j-th original signal OSj as the first sequence image signal is supplied to the signal line Sjk+1 of the (jk+1)-th row, the j-th original signal OSj as the second sequence image signal is supplied to the signal line Sjk+2 of the (jk+2)-th row, and subsequently, the j-th original signal OSj as the third sequence image signal is supplied to the signal line Sjk+3 of the (jk+3)-th row. In the second half period of the first horizontal scanning period, the entirety of the precharging sequence signals PRC (the entirety of the negative precharging sequence signals NPRC and the entirety of the positive precharging sequence signals PPRC) have a non-selection state, and the precharging signal VPRC is not supplied to any one of the signal lines 23. At this time, the fourth image sequence signal SEL4 has a selection state, and the j-th original signal OSj as the fourth sequence image signal is supplied to the signal line Sjk+4 of the (jk+4)-th row.

In the first half period of the second horizontal scanning period in which the scanning line Gi+1 of the (i+1)-th column is selected, the first negative precharging sequence signal NPRC1 has a selection state, and the negative precharging signal VPRC− is supplied to the signal line Sjk+1 of the (jk+1)-th row. The second negative precharging sequence signal NPRC2, the third negative precharging sequence signal NPRC3, the fourth negative precharging sequence signal NPRC4, and the entirety of the positive precharging sequence signals PPRC have a non-selection state. In the first half period of the second horizontal scanning period, the second image sequence signal SEL2 to the fourth image sequence signal SEL4 become a selection state in time-series sequence, the j-th original signal OSj as the second sequence image signal is supplied to the signal line Sjk+2 of the (jk+2)-th row, the j-th original signal OSj as the third sequence image signal is supplied to the signal line Sjk+3 of the (jk+3)-th row, and subsequently, the j-th original signal OSj as the fourth sequence image signal is supplied to the signal line Sjk+4 of the (jk+4)-th row. In the second half period of the second horizontal scanning period, the entirety of the precharging sequence signals PRC (the entirety of the negative precharging sequence signals NPRC and the entirety of the positive precharging sequence signals PPRC) have a non-selection state, and the precharging signal VPRC is not supplied to any one of the signal lines 23. At this time, the first image sequence signal SEL1 has a selection state in time-series sequence, and the j-th original signal OSj as the first sequence image signal is supplied to the signal line Sjk+1 of the (jk+1)-th row.

In the embodiment, k is equal to four, and as illustrated in FIG. 9, one vertical scanning period includes four horizontal scanning periods from the first to four horizontal scanning periods. The first horizontal scanning period is a scanning period in which the scanning line Gi of the i-th column is selected, the second horizontal scanning period is a scanning period in which the scanning line Gi+1 of the (i+1)-th column is selected, the third horizontal scanning period is a scanning period in which the scanning line Gi+2 of the (i+2)-th column is selected, and the fourth horizontal scanning period is a scanning period in which the scanning line Gi+3 of the (i+3)-th column is selected. In each of the four horizontal scanning periods, the negative precharging signal VPRC− is supplied to a part (one signal line group in the embodiment) of the four signal line groups, and then image signals are supplied thereto, and image signals are supplied to the remainder of the four signal line groups without the negative precharging signal VPRC-being supplied thereto. In other words, in the first half period of each of the four horizontal scanning periods, the negative precharging signal VPRC− is supplied to the part (one signal line group in the embodiment) of the four signal line groups, and the image signals are supplied to the remainder of the four signal line groups, and in the second half period, the image signals are supplied to the part of the four signal line groups, to which the negative precharging signal VPRC− is supplied. At this time, since the signal line group to which the negative precharging signal VPRC− is supplied is changed each horizontal scanning period, the negative precharging signal VPRC− is supplied to each of the four signal line groups the same times in the first to fourth horizontal scanning periods. In the embodiment, the negative precharging signal VPRC− is supplied to each of the four signal line groups once in the four horizontal scanning periods. Thereafter, a cycle from the first to fourth horizontal scanning periods is repeated with respect to the entirety of the horizontal scanning periods.

In the embodiment, the frequency of precharging operations is reduced compared to the first embodiment, and thus it is possible to display a high-quality image, and reduce power consumption.

Third Embodiment

Figure 10:
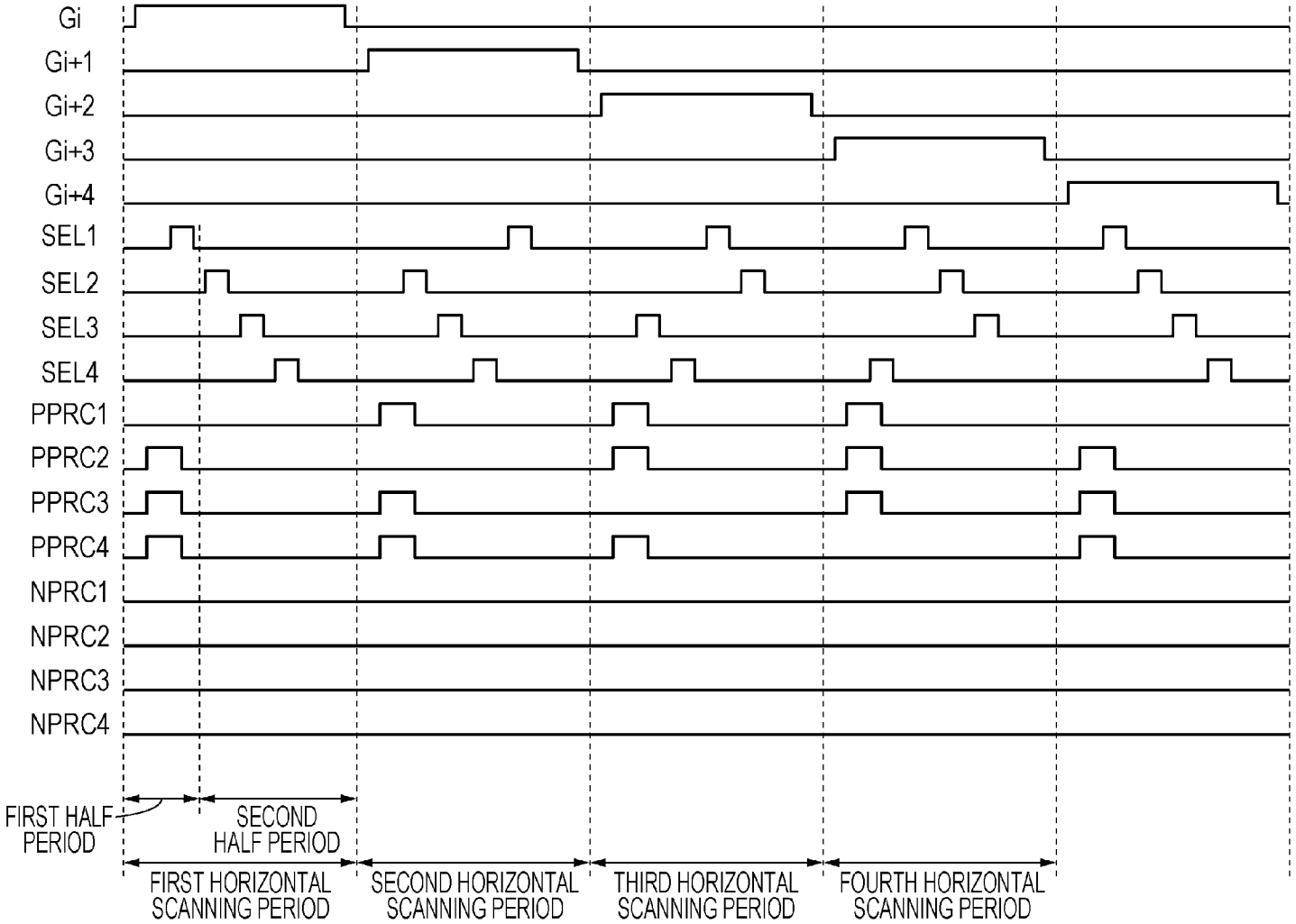
FIG. 10 is an example of a timing chart illustrating a drive method according to a third embodiment.
Figure 11:
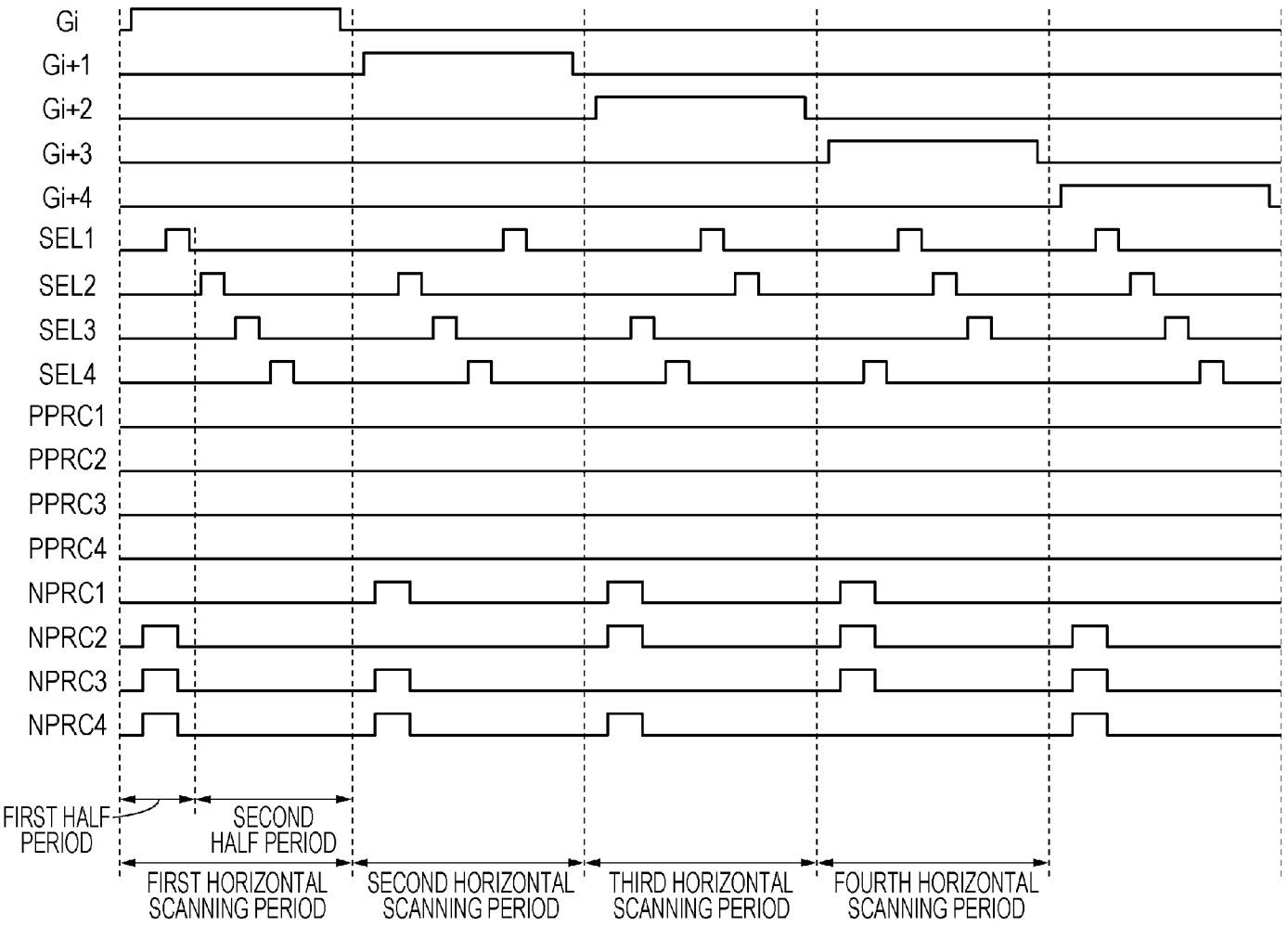
FIG. 11 is an example of a timing chart illustrating the drive method according to the third embodiment.

Embodiment 2—Frequency of Precharging Operations is Different in First Embodiment FIG. 10 is an example of a timing chart illustrating a drive method according to a third embodiment, and illustrates a timing chart for the positive polarity driving. FIG. 11 is an example of a timing chart illustrating the drive method according to the third embodiment, and illustrates a timing chart for the negative polarity driving. Subsequently, a method of driving the electro-optical apparatus 20 according to the third embodiment will be described with reference to FIGS. 10 and 11. The same reference signs will be assigned to the same configuration portions as in the first embodiment, and the descriptions thereof will not be repeated.

In the method of driving the electro-optical apparatus 20 of the embodiment illustrated in FIGS. 10 and 11, the frequency of precharging operations is different from that in the method of driving the electro-optical apparatus 20 of the first embodiment illustrated in FIGS. 5 and 6. Other configurations are substantially the same as the first embodiment.

In the method (refer to FIGS. 5 and 6) of driving the electro-optical apparatus 20 of the first embodiment, I is equal to 0.5, and the precharging operation is executed twice in four horizontal scanning periods. In contrast, in the method of driving the electro-optical apparatus 20 of the embodiment (refer to FIGS. 10 and 11), I is equal to one third, and the precharging signal VPRC is supplied to each of the signal lines 23 once in 4/3 horizontal scanning periods. That is, the precharging signal VPRC is supplied to each of the signal lines 23 three times in four horizontal scanning periods. At this time, in the first horizontal scanning period, the precharging signals VPRC are supplied to the second to the fourth sequence signal line groups. In the second horizontal scanning period, the precharging signals VPRC are supplied to the first sequence signal line group, the third sequence signal line group, and the fourth sequence signal line group. In the third horizontal scanning period, the precharging signals VPRC are supplied to the first sequence signal line group, the second sequence signal line group, and the fourth sequence signal line group. In the fourth horizontal scanning period, the precharging signals VPRC are supplied to the first to third sequence signal line groups. In brief, the precharging signal VPRC is supplied to each of the signal lines 23 three times in the four horizontal scanning periods.

First, the positive polarity drive method will be described with reference to FIG. 10. At the positive polarity driving, the entirety of the negative precharging sequence signals NPRC have a non-selection state at all times, and a part of the positive precharging sequence signals PPRC have a selection state.

As illustrated in FIG. 10, in the first half period of the first horizontal scanning period in which the scanning line Gi of the i-th column is selected, the second positive sequence signal PPRC2, the third positive precharging sequence signal PPRC3 and the fourth positive precharging sequence signal PPRC4 have a selection state, and the positive precharging signals VPRC+ are supplied to the signal line Sjk+2 of the (jk+2)-th row, the signal line Sjk+3 of the (jk+3)-th row, and the signal line Sjk+4 of the (jk+4)-th row. The first positive precharging sequence signal PPRC1, and the entirety of the negative precharging sequence signals NPRC have a non-selection state. In the first half period of the first horizontal scanning period, the first image sequence signal SEL1 has a selection state, and the j-th original signal OSj as the first sequence image signal is supplied to the signal line Sjk+1 of the (jk+1)-th row. In the second half period of the first horizontal scanning period, the entirety of the precharging sequence signals PRC (the entirety of the positive precharging sequence signals PPRC and the entirety of the negative precharging sequence signals NPRC) have a non-selection state, and the precharging signal VPRC is not supplied to any one of the signal lines 23. At this time, the second image sequence signal SEL2, the third image sequence signal SEL3, and the fourth image sequence signal SEL4 have a selection state in time-series sequence, and the j-th original signal OSj as the second sequence image signal is supplied to the signal line Sjk+2 of the (jk+2)-th row, then the j-th original signal OSj as the third sequence image signal is supplied to the signal line Sjk+3 of the (jk+3)-th row, and then the j-th original signal OSj as the fourth sequence image signal is supplied to the signal line Sjk+4 of the (jk+4)-th row.

In the first half period of the second horizontal scanning period in which the scanning line Gi+1 of the (i+1)-th column is selected, the first positive precharging sequence signal PPRC1, the third positive precharging sequence signal PPRC3, and the fourth positive precharging sequence signal PPRC4 have a selection state, the positive precharging signals VPRC+ are supplied to the signal line Sjk+1 of the (jk+1)-th row, the signal line Sjk+3 of the (jk+3)-th row, and the signal line Sjk+4 of the (jk+4)-th row. The second positive precharging sequence signal PPRC2 and the entirety of the negative precharging sequence signals NPRC have a non-selection state. In the first half period of the second horizontal scanning period, the second image sequence signal SEL2 has a selection state, and the j-th original signal OSj as the second sequence image signal is supplied to the signal line Sjk+2 of the (jk+2)-th row. In the second half period of the second horizontal scanning period, the entirety of the precharging sequence signals PRC (the entirety of the positive precharging sequence signals PPRC and the entirety of the negative precharging sequence signals NPRC) have a non-selection state, and the precharging signal VPRC is not supplied to any one of the signal lines 23. At this time, the third image sequence signal SEL3, the fourth image sequence signal SEL4, and the first image sequence signal SEL1 have a selection state in time-series sequence, and the j-th original signal OSj as the third sequence image signal is supplied to the signal line Sjk+3 of the (jk+3)-th row, then the j-th original signal OSj as the fourth sequence image signal is supplied to the signal line Sjk+4 of the (jk+4)-th row, and then the j-th original signal OSj as the first sequence image signal is supplied to the signal line Sjk+1 of the (jk+1)-th row.

In the embodiment, k is equal to four, and as illustrated in FIG. 10, one vertical scanning period includes four horizontal scanning periods from the first to four horizontal scanning periods. The first horizontal scanning period is a scanning period in which the scanning line Gi of the i-th column is selected, the second horizontal scanning period is a scanning period in which the scanning line Gi+1 of the (i+1)-th column is selected, the third horizontal scanning period is a scanning period in which the scanning line Gi+2 of the (i+2)-th column is selected, and the fourth horizontal scanning period is a scanning period in which the scanning line Gi+3 of the (i+3)-th column is selected. In each of the four horizontal scanning periods, the positive precharging signals VPRC+ are supplied to a part (three signal line groups in the embodiment) of the four signal line groups, and then image signals are supplied thereto, and an image signal is supplied to the remainder of the four signal line groups without the positive precharging signal VPRC+ being supplied thereto. In other words, in the first half period of each of the four horizontal scanning periods, the positive precharging signals VPRC+ are supplied to the part (three signal line groups in the embodiment) of the four signal line groups, and the image signal is supplied to the remainder of the four signal line groups, and in the second half period, the image signals are supplied to the part of the four signal line groups, to which the positive precharging signals VPRC+ are supplied. At this time, since the signal line groups to which the positive precharging signals VPRC+ are supplied are changed each horizontal scanning period, the positive precharging signal VPRC+ is supplied to each of the four signal line groups the same times in the first to fourth horizontal scanning periods. In the embodiment, the positive precharging signal VPRC+ is supplied to each of the four signal line groups three times in the four horizontal scanning periods. Thereafter, a cycle from the first to fourth horizontal scanning periods is repeated with respect to the entirety of the horizontal scanning periods.

Subsequently, the negative polarity drive method will be described with reference to FIG. 11. At the negative polarity driving, the entirety of the positive precharging sequence signals PPRC have a non-selection state at all times, and a part of the negative precharging sequence signals NPRC have a selection state.

As illustrated in FIG. 11, in the first half period of the first horizontal scanning period in which the scanning line Gi of the i-th column is selected, the second negative precharging sequence signal NPRC2, the third negative precharging sequence signal NPRC3, and the fourth negative precharging sequence signal NPRC4 have a selection state, and the negative precharging signals VPRC− are supplied to the signal line Sjk+2 of the (jk+2)-th row, the signal line Sjk+3 of the (jk+3)-th row, and the signal line Sjk+4 of the (jk+4)-th row. The first negative precharging sequence signal NPRC1 and the entirety of the positive precharging sequence signals PPRC have a non-selection state. In the first half period of the first horizontal scanning period, the first image sequence signal SEL1 has a selection state in time-series sequence, and the j-th original signal OSj as the first sequence image signal is supplied to the signal line Sjk+1 of the (jk+1)-th row. In the second half period of the first horizontal scanning period, the entirety of the precharging sequence signals PRC (the entirety of the negative precharging sequence signals NPRC and the entirety of the positive precharging sequence signals PPRC) have a non-selection state, and the precharging signal VPRC is not supplied to any one of the signal lines 23. At this time, the second image sequence signal SEL2, the third image sequence signal SEL3, and the fourth image sequence signal SEL4 have a selection state in time-series sequence, and the j-th original signal OSj as the second sequence image signal is supplied to the signal line Sjk+2 of the (jk+2)-th row, then the j-th original signal OSj as the third sequence image signal is supplied to the signal line Sjk+3 of the (jk+3)-th row, and then the j-th original signal OSj as the fourth sequence image signal is supplied to the signal line Sjk+4 of the (jk+4)-th row.

In the first half period of the second horizontal scanning period in which the scanning line Gi+1 of the (i+1)-th column is selected, the first negative precharging sequence signal NPRC1, the third negative precharging sequence signal NPRC3, and the fourth negative precharging sequence signal NPRC4 have a selection state, and the negative precharging signals VPRC− are supplied to the signal line Sjk+1 of the (jk+1)-th row, the signal line Sjk+3 of the (jk+3)-th row, and the signal line Sjk+4 of the (jk+4)-th row. The second negative precharging sequence signal NPRC2 and the entirety of the positive precharging sequence signals PPRC have a non-selection state. In the first half period of the second horizontal scanning period, the second image sequence signal SEL2 has a selection state in time-series sequence, and the j-th original signal OSj as the second sequence image signal is supplied to the signal line Sjk+2 of the (jk+2)-th row. In the second half period of the second horizontal scanning period, the entirety of the precharging sequence signals PRC (the entirety of the negative precharging sequence signals NPRC and the entirety of the positive precharging sequence signals PPRC) have a non-selection state, and the precharging signal VPRC is not supplied to any one of the signal lines 23. At this time, the third image sequence signal SEL3, the fourth image sequence signal SEL4, and the first image sequence signal SEL1 have a selection state in time-series sequence, the j-th original signal OSj as the third sequence image signal is supplied to the signal line Sjk+3 of the (jk+3)-th row, then the j-th original signal OSj as the fourth sequence image signal is supplied to the signal line Sjk+4 of the (jk+4)-th row, and then the j-th original signal OSj as the first sequence image signal is supplied to the signal line Sjk+1 of the (jk+1)-th row.

In the embodiment, k is equal to four, and as illustrated in FIG. 11, one vertical scanning period includes four horizontal scanning periods from the first to four horizontal scanning periods. The first horizontal scanning period is a scanning period in which the scanning line Gi of the i-th column is selected, the second horizontal scanning period is a scanning period in which the scanning line Gi+1 of the (i+1)-th column is selected, the third horizontal scanning period is a scanning period in which the scanning line Gi+2 of the (i+2)-th column is selected, and the fourth horizontal scanning period is a scanning period in which the scanning line Gi+3 of the (i+3)-th column is selected. In each of the four horizontal scanning periods, the negative precharging signals VPRC− are supplied to a part (three signal line groups in the embodiment) of the four signal line groups, and then image signals are supplied thereto, and an image signal is supplied to the remainder of the four signal line groups without the negative precharging signal VPRC− being supplied thereto. In other words, in the first half period of each of the four horizontal scanning periods, the negative precharging signals VPRC− are supplied to the part (three signal line groups in the embodiment) of the four signal line groups, and the image signal is supplied to the remainder of the four signal line groups, and in the second half period, the image signals are supplied to the part of the four signal line groups, to which the negative precharging signals VPRC− are supplied. At this time, since the signal line groups to which the negative precharging signals VPRC− are supplied are changed each horizontal scanning period, the negative precharging signal VPRC− is supplied to each of the four signal line groups the same times in the first to fourth horizontal scanning periods. In the embodiment, the negative precharging signal VPRC− is supplied to each of the four signal line groups three times in the four horizontal scanning periods. Thereafter, a cycle from the first to fourth horizontal scanning periods is repeated with respect to the entirety of the horizontal scanning periods.

As described above, in the embodiment, the precharging operation is executed three times in the four horizontal scanning periods. The precharging operation is executed, but it is not necessary to design a dedicated precharging period for each horizontal scanning period, and thus it is possible to realize high-speed driving. Since the frequency of precharging operations is reduced compared to the first embodiment, the occurrence of crosstalk is prevented.

Fourth Embodiment

Embodiment—Precharging Circuit is Different

Figure 12:
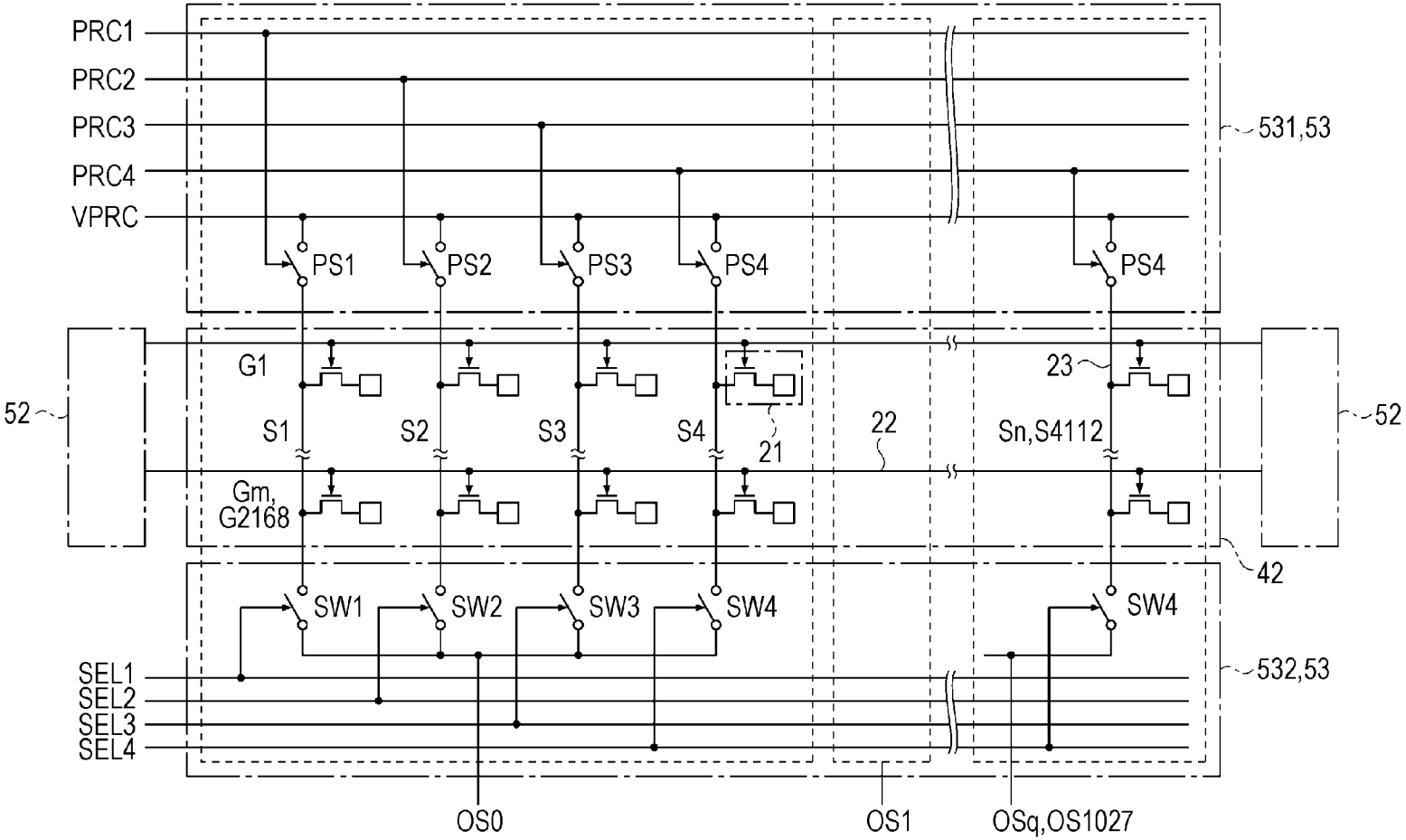
FIG. 12 is a diagram illustrating a circuit configuration of a signal line drive circuit according to a fourth embodiment.
Figure 13:
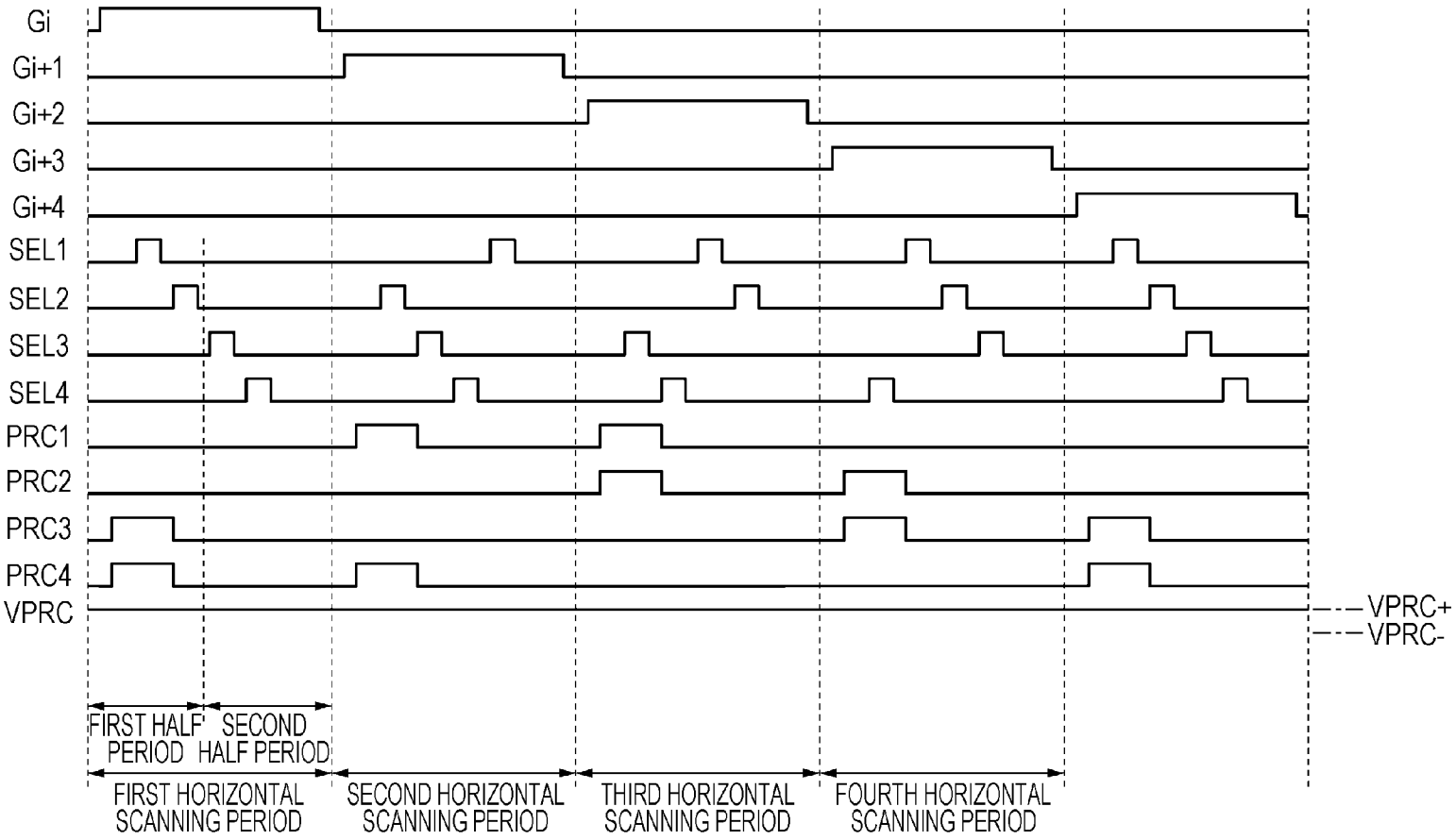
FIG. 13 is an example of a timing chart illustrating a drive method according to the fourth embodiment.
Figure 14:
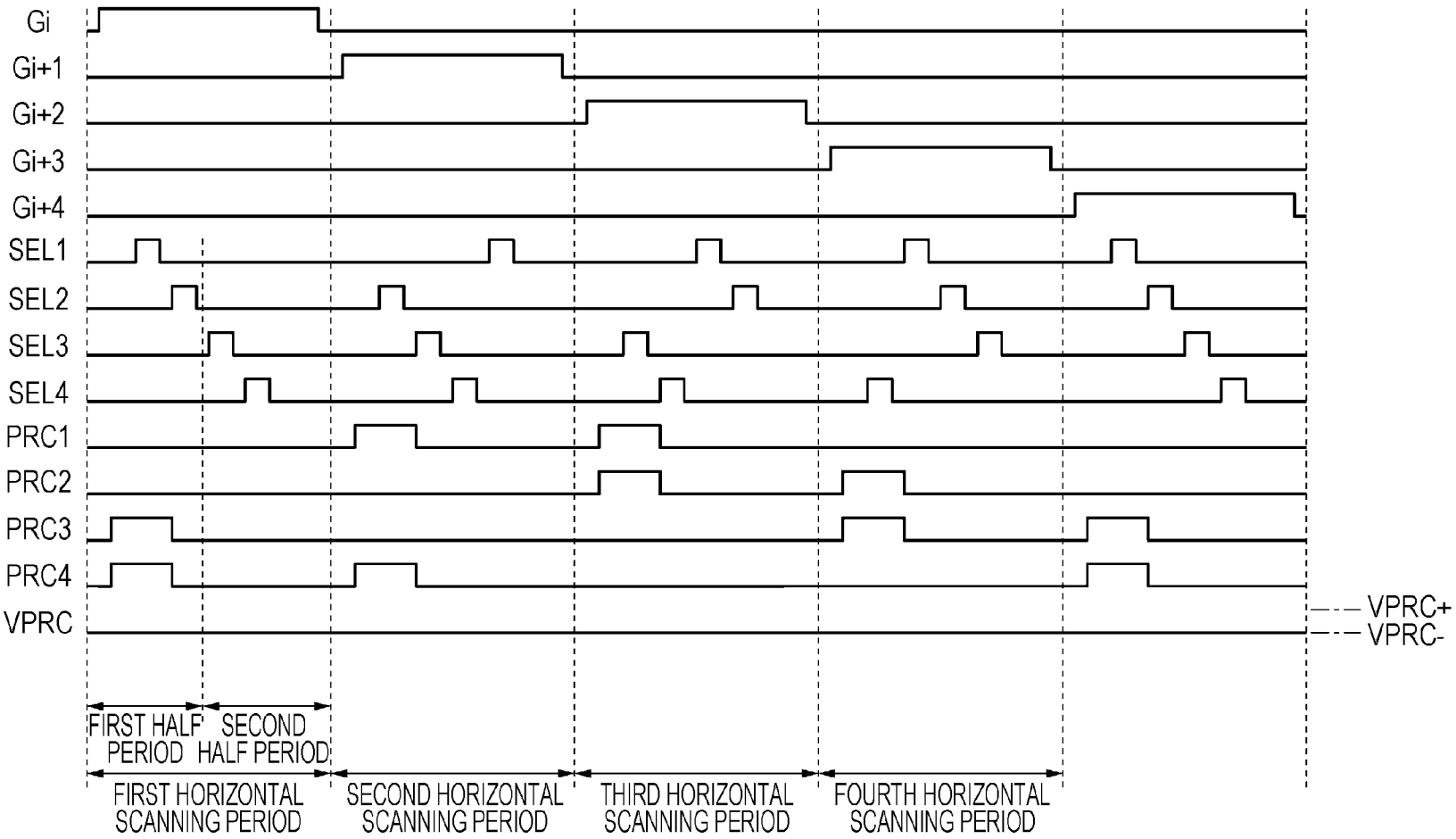
FIG. 14 is an example of a timing chart illustrating the drive method according to the fourth embodiment.

FIG. 12 is a diagram illustrating a circuit configuration of a signal line drive circuit according to a fourth embodiment. FIG. 13 is an example of a timing chart illustrating a drive method according to the fourth embodiment, and illustrates a timing chart for the positive polarity driving. FIG. 14 is an example of a timing chart illustrating the drive method according to the fourth embodiment, and illustrates a timing chart for the negative polarity driving. Subsequently, a method of driving the electro-optical apparatus 20 according to the fourth embodiment will be described with reference to FIGS. 12 to 14. The same reference signs will be assigned to the same configuration portions as in the first to third embodiments, and the descriptions thereof will not be repeated.

In the signal line drive circuit 53 used in the electro-optical apparatus 20 of the embodiment illustrated in FIG. 12, the configuration of the precharging circuit 531 is different from that in the signal line drive circuit 53 used in the electro-optical apparatus 20 of the first to third embodiments illustrated in FIG. 4. Accordingly, a method of driving the electro-optical apparatus 20 of the embodiment is also slightly different from the method of driving the electro-optical apparatus 20 of the first to third embodiments. Other configurations are substantially the same as the first to third embodiments.

The following lines are wired in the precharging circuit 531 used in the electro-optical apparatus 20 of the embodiment: the k precharging sequence lines that correspond to the k types of the precharging sequence signals PRC, and a precharging signal VPRC line through which the precharging signal VPRC is supplied. The precharging signal VPRC includes the positive precharging signal VPRC+ and the negative precharging signal VPRC−.

A p-th precharging sequence signal PRCp is supplied to a p-th precharging sequence line (p is an arbitrary integer between one and k). For example, a first precharging sequence signal PRC1 is supplied to a first precharging sequence line, a second precharging sequence signal PRC2 is supplied to a second precharging sequence signal line and thereafter, similarly, a k-th positive precharging sequence signal PRCk is supplied to a k-th positive precharging sequence line. The positive precharging signal VPRC+ is supplied to the positive precharging signal VPRC line.

The precharging circuit 531 includes (q+1) (that is, n/k) first precharging switches PS1 to (q+1) (that is, n/k) k-th precharging switches PSk. Similar to the pixel transistor 24, each of the first precharging switches PS1 to the k-th precharging switches PSk is formed by a thin film transistor. One end (one of a source and a drain) of a p-th precharging switch PSp is electrically connected to the signal line Sjk+p of the (jk+p)-th row, the other end (the other of the source and the drain) of the p-th precharging switch PSp is electrically connected to the precharging signal VPRC line, and a gate of the p-th precharging switch PSp is electrically connected to the p-th precharging sequence line. Accordingly, when the p-th precharging sequence signal PRCp is a selected signal, the p-th precharging switch PSp is turned on, and the precharging signal VPRC is supplied to the signal line Sjk+p of the (jk+p)-th row. The precharging signal VPRC becomes the positive precharging signal VPRC+ at the positive polarity driving, and becomes the negative precharging signal VPRC at the negative polarity driving. For example, the first precharging switch PS1 is disposed between the precharging signal VPRC line and the signal line S1 of the first row belonging to the first sequence signal line group, and a gate of the first precharging switch PS1 is electrically connected to the first precharging sequence line. For this reason, when the first precharging sequence signal PRC1 is a selected signal, the first precharging switch PS1 is turned on, and the precharging signal VPRC is supplied to the signal line S1 of the first row. Similarly, for example, the fourth precharging switch PS4 is disposed between the precharging signal VPRC line and the signal line S4112 of the 4112th row belonging to the fourth sequence signal line group, and a gate of the fourth precharging switch PS4 is electrically connected to the fourth precharging sequence line. For this reason, when the fourth precharging sequence signal PRC4 is a selected signal, the fourth precharging switch PS4 is turned on, and the precharging signal VPRC is supplied to the signal line S4112 of the 4112th row.

As illustrated in FIG. 13, the precharging signal VPRC becomes the positive precharging signal VPRC+ at the positive polarity driving. As illustrated in FIG. 14, the precharging signal VPRC becomes the negative precharging signal VPRC at the negative polarity driving. Others are substantially the same as the first to third embodiments.

In the first to third embodiments, since the positive precharging signal VPRC line to which the positive precharging signal VPRC+ is supplied is provided separate from the negative precharging signal VPRC line to which the negative precharging signal VPRC− is supplied, the potential of the positive and negative precharging signal VPRC lines is fixed, and it is not necessary to swing the potential of the positive and negative precharging signal VPRC lines. For this reason, in the first to third embodiments, a benefit of low power consumption is obtained. In this embodiment, it is possible to obtain the same other effects as the first to third embodiments, and with a simple circuit configuration, it is possible to realize effects obtained in the first to third embodiments.

The present invention is not limited to the embodiments, and modifications or improvement can be made to the embodiments in various forms. Hereinafter, modification examples will be described.

First Modification Example

Embodiment—Order of Image Sequence Signals is Different

In the first to fourth embodiments, an example of a supply order of the precharging signals VPRC across the first to fourth horizontal scanning periods is illustrated, and the supply order is arbitrarily determined. A supply order of image signals is also arbitrarily determined. For example, as will be described below, the electro-optical apparatus 20 may be driven with the signal line groups going through the precharging operations once in eight horizontal scanning periods from the first horizontal scanning period to an eight horizontal scanning period.

In the first horizontal scanning period, image signals are sequentially supplied to the first sequence signal line group, the second sequence signal line group, the third sequence signal line group, and the fourth sequence signal line group. In the first half period in which the image signals are supplied to the first and second sequence signal line groups, the precharging signals VPRC are supplied to the third and fourth sequence signal line groups. In the second horizontal scanning period, image signals are sequentially supplied to the first sequence signal line group, the second sequence signal line group, the third sequence signal line group, and the fourth sequence signal line group. In the first half period in which the image signals are supplied to the first and second sequence signal line groups, the precharging signals VPRC are supplied to the third and fourth sequence signal line groups. In the third horizontal scanning period, image signals are sequentially supplied to the second sequence signal line group, the third sequence signal line group, the fourth sequence signal line group, and the first sequence signal line group. In the first half period in which the image signals are supplied to the second and third sequence signal line groups, the precharging signals VPRC are supplied to the fourth and first sequence signal line groups. In the fourth horizontal scanning period, image signals are sequentially supplied to the second sequence signal line group, the third sequence signal line group, the fourth sequence signal line group, and the first sequence signal line group. In the first half period in which the image signals are supplied to the second and third sequence signal line groups, the precharging signals VPRC are supplied to the fourth and first sequence signal line groups. In the fifth horizontal scanning period, image signals are sequentially supplied to the third sequence signal line group, the fourth sequence signal line group, the first sequence signal line group, and the second sequence signal line group. In the first half period in which the image signals are supplied to the third and fourth sequence signal line groups, the precharging signals VPRC are supplied to the first and second sequence signal line groups. In the sixth horizontal scanning period, image signals are sequentially supplied to the third sequence signal line group, the fourth sequence signal line group, the first sequence signal line group, and the second sequence signal line group. In the first half period in which the image signals are supplied to the third and fourth sequence signal line groups, the precharging signals VPRC are supplied to the first and second sequence signal line groups. In the seventh horizontal scanning period, image signals are sequentially supplied to the fourth sequence signal line group, the first sequence signal line group, the second sequence signal line group, and the third sequence signal line group. In the first half period in which the image signals are supplied to the fourth and first sequence signal line groups, the precharging signals VPRC are supplied to the second and third sequence signal line groups. In the eighth horizontal scanning period, image signals are sequentially supplied to the fourth sequence signal line group, the first sequence signal line group, the second sequence signal line group, and the third sequence signal line group. In the first half period in which the image signals are supplied to the fourth and first sequence signal line groups, the precharging signals VPRC are supplied to the second and third sequence signal line groups. As such, the precharging signals VPRC may be supplied to the signal line groups in an arbitrary order.

Second Modification Example

Embodiment—Precharging Potential is Different

In the fourth embodiment, the value of the positive precharging signal VPRC+ is different from that of the negative precharging signal VPRC−, but the values may be the same. For example, the positive precharging signal VPRC+ and the negative precharging signal VPRC− may have a common potential.

The entire disclosure of Japanese Patent Application No. 2013-248932, filed Dec. 12, 2013 is expressly incorporated by reference herein.

What is claimed is:

1. An electro-optical apparatus comprising:

a plurality of scanning lines;

a plurality of signal lines;

pixels that are disposed to correspond to the intersections of the plurality of scanning lines and the plurality of signal lines, respectively; and a drive unit that supplies drive signals to the plurality of scanning lines and the plurality of signal lines, wherein the plurality of signal lines are divided into k signal line groups corresponding to k image sequence lines (k is an integer of two or greater), wherein the drive unit includes a precharging circuit that supplies precharging signals to the plurality of signal lines, and an image signal circuit that supplies image signals to the plurality of signal lines, wherein the image signal circuit includes k groups of switches which are electronically connected to the k signal line groups and the k image sequence lines, wherein the precharging circuit includes k groups of precharging switches which are electrically connected to the k signal line groups and k precharging sequence lines, wherein when supplying image signals to the k signal line groups in a horizontal scanning period, the drive unit supplies precharging signals to a part of the k signal line groups, and then supplies the image signals thereto, and in contrast, supplies the image signals to the remainder of the k signal line groups without supplying the precharging signals thereto, wherein in a first horizontal scanning period, the drive unit supplies the precharging signals to the part of the k signal line groups, and then supplies the image signals thereto, and in contrast, supplies the image signals to the remainder of the k signal line groups without supplying the precharging signals thereto, and wherein in a second horizontal scanning period subsequent to the first horizontal scanning period, the drive unit supplies the precharging signals to the part of the k signal line groups, and then supplies the image signals thereto, and in contrast, supplies the image signals to the remainder of the k signal line groups without supplying the precharging signals thereto, and wherein the signal lines to which the precharging signals are supplied are different between the first horizontal scanning period and the second horizontal scanning period.

2. The electro-optical apparatus according to claim 1, wherein the precharging circuit includes 2k precharging sequence lines and 2k groups of precharging switches, wherein the k precharging sequence lines include k positive precharging sequence lines and k negative precharging sequence lines, wherein the 2k groups of precharging switches include k groups of positive precharging switches and k groups of negative precharging switches.

3. Electronic equipment that is provided with the electro-optical apparatus according to claim 1.

4. An electro-optical apparatus comprising:

a plurality of scanning lines;

a plurality of signal lines;

pixels that are disposed to correspond to the intersections of the plurality of scanning lines and the plurality of signal lines, respectively; and a drive unit that supplies drive signals to the plurality of scanning lines and the plurality of signal lines, wherein the plurality of signal lines are divided into k signal line groups corresponding to k image sequence lines (k is an integer of two or greater), wherein the drive unit includes a precharging circuit that supplies precharging signals to the plurality of signal lines, and an image signal circuit that supplies image signals to the plurality of signal lines, wherein the image signal circuit includes k groups of switches which are electronically connected to the k signal line groups and the k image sequence lines, wherein the precharging circuit includes k groups of precharging switches which are electrically connected to the k signal line groups and k precharging sequence lines, wherein when supplying image signals to the k signal line groups in a horizontal scanning period, the drive unit supplies precharging signals to a part of the k signal line groups, and then supplies the image signals thereto, and in contrast, supplies the image signals to the remainder of the k signal line groups without supplying the precharging signals thereto wherein a vertical scanning period includes at least first to k-th horizontal scanning periods, wherein in each of the first to k-th horizontal scanning periods, the drive unit supplies the precharging signals to the part of the k signal line groups, and then supplies the image signals thereto, and in contrast, supplies the image signals to the remainder of the k signal line groups without supplying the precharging signals thereto, and wherein the drive unit supplies the precharging signals to the entirety of the k signal line groups in the first to k-th horizontal scanning periods.

5. The electro-optical apparatus according to claim 4, wherein the vertical scanning period includes a horizontal scanning period in which the image signals are supplied to the entirety of the k signal line groups without the precharging signals being supplied thereto.

6. The electro-optical apparatus according to claim 4, wherein in the vertical scanning period, the drive unit supplies the precharging signals to each of the k signal line groups multiple times, and wherein a period between the supply of a precharging signal and the supply of a subsequent precharging signal with respect to a signal line group is set to 32 horizontal scanning periods or less.

7. Electronic equipment that is provided with the electro-optical apparatus according to claim 4.

8. The electro-optical apparatus according to claim 4, wherein the precharging circuit includes 2k precharging sequence lines and 2k groups of precharging switches, wherein the k precharging sequence lines include k positive precharging sequence lines and k negative precharging sequence lines, wherein the 2k groups of precharging switches include k groups of positive precharging switches and k groups of negative precharging switches.

9. An electro-optical apparatus comprising:

a plurality of scanning lines;

a plurality of signal lines;

pixels that are disposed to correspond to the intersections of the plurality of scanning lines and the plurality of signal lines, respectively; and a drive unit that supplies drive signals to the plurality of scanning lines and the plurality of signal lines, wherein the plurality of signal lines are divided into k signal line groups corresponding to k image sequence lines (k is an integer of two or greater), wherein the drive unit includes a precharging circuit that supplies precharging signals to the plurality of signal lines, and an image signal circuit that supplies image signals to the plurality of signal lines, wherein the image signal circuit includes k groups of switches which are electronically connected to the k signal line groups and the k image sequence lines, wherein the precharging circuit includes k groups of precharging switches which are electrically connected to the k signal line groups and k precharging sequence lines, wherein the k signal line groups including a first signal line group and a second signal line group different from the first signal line group, and wherein the drive unit supplies the image signals to the first signal line group and supplies the precharging signals to the second signal line group in a first period of a horizontal scanning period, and the drive unit supplies the image signals to the second signal line group in a second period different from the first period of the horizontal scanning period.

10. The electro-optical apparatus according to claim 9, wherein the precharging circuit includes 2k precharging sequence lines and 2k groups of precharging switches, wherein the k precharging sequence lines include k positive precharging sequence lines and k negative precharging sequence lines, wherein the 2k groups of precharging switches include k groups of positive precharging switches and k groups of negative precharging switches.

11. Electronic equipment that is provided with the electro-optical apparatus according to claim 9.

* * * * *